US011982493B2

(12) United States Patent
Miyata et al.

(10) Patent No.: US 11,982,493 B2
(45) Date of Patent: May 14, 2024

(54) THERMALLY CONDUCTIVE PIPE, HEAT TREATMENT DEVICE, AND TREATMENT SYSTEM

(71) Applicant: FUJIFILM Business Innovation Corp., Tokyo (JP)

(72) Inventors: Toshiyuki Miyata, Kanagawa (JP); Toru Inoue, Kanagawa (JP); Kazuyoshi Itoh, Kanagawa (JP); Toko Hara, Kanagawa (JP); Keitaro Mori, Kanagawa (JP); Sou Morizaki, Kanagawa (JP); Motoharu Nakao, Kanagawa (JP); Kiyoshi Koyanagi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 155 days.

(21) Appl. No.: 17/333,030

(22) Filed: May 28, 2021

(65) Prior Publication Data

US 2022/0196339 A1 Jun. 23, 2022

(30) Foreign Application Priority Data

Dec. 22, 2020 (JP) ..... 2020-211954

(51) Int. Cl.
*F28D 15/04* (2006.01)
*F28F 1/40* (2006.01)

(52) U.S. Cl.
CPC ..... *F28D 15/046* (2013.01); *F28F 1/405* (2013.01)

(58) Field of Classification Search
CPC ..... F28D 15/04; F28D 15/046; F28F 1/405; G03G 15/2017; G03G 15/2021
See application file for complete search history.

(56) References Cited

U.S. PATENT DOCUMENTS 4,116,266 A * 9/1978 Sawata ..... F28D 15/046 138/40
4,159,737 A * 7/1979 Biermann ..... F28D 15/0258 165/104.27
5,000,252 A * 3/1991 Faghri ..... F28D 20/023 165/41
5,046,553 A * 9/1991 Lindner ..... F28D 15/046 122/366

(Continued)

FOREIGN PATENT DOCUMENTS

JP H04-089126 3/1992
JP H11337279 12/1999

(Continued)

*Primary Examiner* — Tho V Duong
(74) *Attorney, Agent, or Firm* — JCIPRNET

(57) ABSTRACT

A thermally conductive pipe includes a pipe of which both end portions are closed, a working liquid that is sealed inside the pipe and vaporizes and liquefies, and a liquid transfer unit that exists along a longitudinal direction inside the pipe and transfers the liquefied working liquid at least in the longitudinal direction, in which the liquid transfer unit has, in a case of being viewed in a cross section of the pipe, which is orthogonal to the longitudinal direction, a first liquid transfer unit that is in contact with at least a partial range of an inner wall surface of the pipe and a second liquid transfer unit that is not in contact with the inner wall surface of the pipe and the first liquid transfer unit.

5 Claims, 13 Drawing Sheets

(56) References Cited

U.S. PATENT DOCUMENTS

| | | | | |
|---|---|---|---|---|
| 6,725,910 | B2 * | 4/2004 | Ishida | F28D 15/046 165/104.21 |
| 7,051,794 | B2 * | 5/2006 | Luo | F28D 15/0283 174/15.2 |
| 8,068,758 | B2 | 11/2011 | Kaji | |
| 8,218,993 | B2 | 7/2012 | Kaji | |
| 2006/0086482 | A1 * | 4/2006 | Thayer | F28D 15/0241 165/104.26 |
| 2007/0127958 | A1 * | 6/2007 | Matsuura | G03G 15/2039 399/328 |
| 2009/0016765 | A1 * | 1/2009 | Honda | G03G 15/6573 399/94 |
| 2009/0084526 | A1 * | 4/2009 | Chang | F28D 15/046 165/104.26 |
| 2009/0175658 | A1 * | 7/2009 | Iwamoto | G03G 9/08735 430/111.4 |
| 2010/0243213 | A1 * | 9/2010 | Obara | F28D 15/02 165/104.26 |
| 2011/0303392 | A1 * | 12/2011 | Horiuchi | F28D 15/046 165/104.26 |

FOREIGN PATENT DOCUMENTS

| | | |
|---|---|---|
| JP | 5258386 | 8/2013 |
| JP | 2017083138 | 5/2017 |

* cited by examiner

THERMALLY CONDUCTIVE PIPE, HEAT TREATMENT DEVICE, AND TREATMENT SYSTEM

CROSS-REFERENCE TO RELATED APPLICATIONS

This application is based on and claims priority under 35 USC 119 from Japanese Patent Application No. 2020-211954 filed Dec. 22, 2020.

BACKGROUND

(i) Technical Field

The present invention relates to a thermally conductive pipe, a heat treatment device, and a treatment system.

(ii) Related Art

In the related art, as thermally conductive pipes, which are called heat pipes, for example, heat pipes described in JP1999-337279A and JP2017-083138A below are known.

In JP1999-337279A, a heat pipe including a pipe body that includes a hollow portion, of which both ends are sealed, has a working fluid in the hollow portion, and carries out heat exchange with the outside and a wick that is mounted in the hollow portion of the pipe body and provides a capillary force such that the working fluid condensed by a condensing unit can be returned to an evaporating unit, the heat pipe practically having a cylindrical structure as the wick is made by braiding a large number of wire rods in a spiral shape is described.

In JP2017-083138A, a heat pipe that has a container, a working fluid that is sealed in the container, and a wick that is provided on an inner surface of the container and is made of a sintered metal obtained by sintering metal powder, the heat pipe, in which the occupancy of the wick in a heat absorbing unit of the container is 65% to 90%, is described.

SUMMARY

Aspects of non-limiting embodiments of the present disclosure relate to a thermally conductive pipe, a heat treatment device, and a treatment system that may improve thermal conduction performance in a longitudinal direction, compared only to a case where a liquid transfer unit that transfers a working liquid is in contact with the entire area of an inner wall surface of a pipe in a case of being viewed in a cross section of the pipe, which is orthogonal to the longitudinal direction.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a thermally conductive pipe including a pipe of which both end portions are closed, a working liquid that is sealed inside the pipe and vaporizes and liquefies, and a liquid transfer unit that exists along a longitudinal direction inside the pipe and transfers the liquefied working liquid at least in the longitudinal direction. The liquid transfer unit has, in a case of being viewed in a cross section of the pipe, which is orthogonal to the longitudinal direction, a first liquid transfer unit that is in contact with at least a partial range of an inner wall surface of the pipe and a second liquid transfer unit that is not in contact with the inner wall surface of the pipe and the first liquid transfer unit.

BRIEF DESCRIPTION OF THE DRAWINGS

Exemplary embodiment(s) of the present invention will be described in detail based on the following figures, wherein.

DETAILED DESCRIPTION

Hereinafter, modes for carrying out the present invention (simply referred to as exemplary embodiments in the present specification) will be described with reference to the drawings.

First Exemplary Embodiment

Figure 1A:
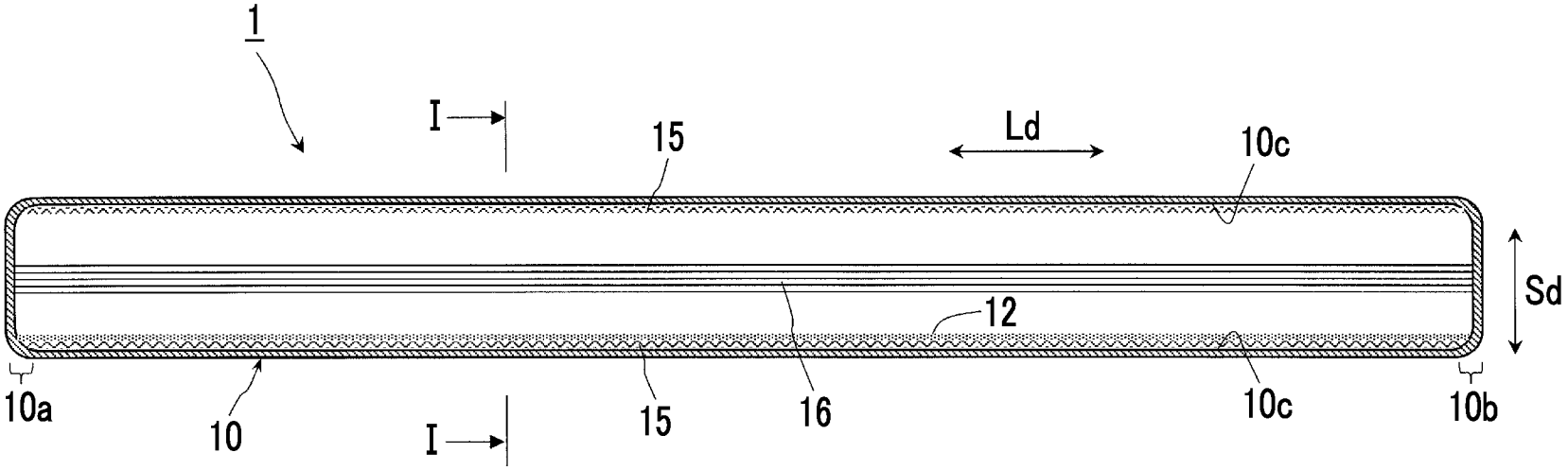
FIG. 1A is a schematic cross sectional view taken along a longitudinal direction of a thermally conductive pipe according to a first exemplary embodiment.
Figure 1B:
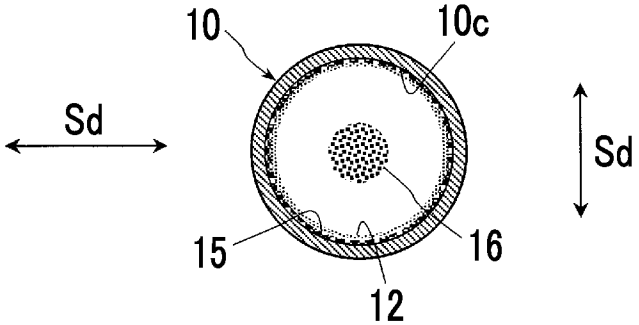
FIG. 1B is a schematic cross sectional view of the thermally conductive pipe of FIG. 1A taken along line I-I.

FIGS. 1A and 1B show a heat pipe 1, which is an example of a thermally conductive pipe according to a first exemplary embodiment. In the drawings such as FIGS. 1A and 1B, the reference sign Ld indicates a longitudinal direction of the heat pipe 1, and the reference sign Sd indicates a lateral direction, which is a direction intersecting (practically orthogonal to) the longitudinal direction Ld of the heat pipe 1.

Thermally Conductive Pipe

The heat pipe 1, which is an example of the thermally conductive pipe, includes a pipe 10 of which both end portions 10*a* and 10*b* are closed, a working liquid 12 that is sealed inside the pipe 10 and vaporizes and liquefies, and a first liquid transfer unit 15 and a second liquid transfer unit 16 that exist along the longitudinal direction Ld inside the pipe 10 and transfer the liquefied working liquid 12 in the longitudinal direction Ld.

The pipe 10 is a pipe having a hollow structure, which is made of a metal having relatively high thermal conductivity and is long in one direction and of which a cross section is circular. The circular cross section is not limited to a perfect circle, which is perfectly circular, and includes a slightly distorted circle. The slightly distorted circle means, for example, a circle having a roundness of 200 μm or less. Insofar as both end portions 10*a* and 10*b* of the pipe 10 are sealed to an extent that the working liquid 12 has no possibility of leakage, a closing form and a structure thereof are not particularly limited. One of both end portions 10*a* and 10*b* may have an end portion structure that is closed from the beginning.

Although a pipe appropriate for application is used as such a pipe 10, for example, from a perspective of making the entire heat pipe 1 having a relatively small cross-sectional area in the lateral direction Sd, a small-diameter cylindrical pipe of which a circular cross section has, for example, an outer diameter of 3 mm or less is used. That is, from a perspective of being manufacturable and securing minimum strength, the outer diameter of the pipe 10 is, for example, preferably 2 mm or more.

In addition, the pipe 10 is a thin pipe of which a thickness is, for example, preferably within a range of 0.05 mm or more and 0.2 mm or less.

The small-diameter and thin pipe 10 requires a small provision space and low thermal capacity and has good thermal conductivity.

Further, although the pipe 10 may be formed of a metal material such as stainless steel and aluminum, the pipe is formed of, for example, preferably oxygen-free copper (99.96% or more high-purity copper that barely contains oxides) from a perspective of obtaining high thermal conductivity and processing ease.

In addition, in a case where there is a possibility that a surface thereof is oxidized, the surface of the pipe 10 is, for example, subjected to antioxidant treatment. Examples of the antioxidant treatment include treatment such as plating, applying an antioxidant, and coating.

The working liquid 12 is a medium that vaporizes (generally evaporates) and liquefies (condenses) due to a temperature distribution inside the pipe 10. In addition, a required amount of the working liquid 12 is sealed inside the pipe 10.

In the first exemplary embodiment, for example, pure water is used as the working liquid 12. In addition, in FIGS. 1A and 1B, in order to help understanding, the working liquid 12 is shown in an enlarged manner.

As shown in FIG. 1A, both of the first liquid transfer unit 15 and the second liquid transfer unit 16 are portions that are arranged to exist along the longitudinal direction Ld inside the pipe 10 and are formed of a material allowing the working liquid 12 liquefied inside the pipe 10 to be transferred at least along the longitudinal direction Ld of the pipe 10. In addition, the transfer of the liquefied working liquid 12 in the first liquid transfer unit 15 and the second liquid transfer unit 16 is performed by a capillary force generated from a low temperature region of the pipe 10 toward a high temperature region, which has a temperature relatively higher than the low temperature region.

As shown in FIG. 1B, the first liquid transfer unit 15 is arranged in a state of being in contact with the entire range of an inner wall surface 10*c* in a circumferential direction in a case of being viewed in a cross section of the pipe 10, which is orthogonal to the longitudinal direction Ld. In addition, as shown in FIG. 1A, the first liquid transfer unit 15 at this time is arranged also in a state of being in contact with a portion of the inner wall surface 10*c* of the pipe 10 along the longitudinal direction Ld. The state where the first liquid transfer unit 15 is in contact with the entire area of the inner wall surface 10*c* is not limited to a case of being in complete contact with the entire area of the inner wall surface 10*c* in the circumferential direction, and also includes a case where a part of the first liquid transfer unit 15 is in a non-contact state in which the first liquid transfer unit is slightly floated while being close to the inner wall surface 10*c*, in a strict sense.

Such a first liquid transfer unit 15 is formed of a material, such as a plurality of wire rods made of a metal, a metal net formed by crossing a plurality of metal wires into a net shape, and a sintered metal obtained by sintering metal powder.

The first liquid transfer unit 15 of the first exemplary embodiment is formed of a net-shaped material (wire mesh) made of a metal wire. In addition, the first liquid transfer unit 15 made of the net-shaped material is configured such that the mesh has, for example, a size of approximately 0.1 to 0.5 mm. In addition, the first liquid transfer unit 15 made of the net-shaped material is formed in almost a cylindrical shape as a whole such that the first liquid transfer unit can be inserted into the pipe 10.

On the other hand, as shown in FIG. 1B, the second liquid transfer unit 16 is arranged in a state of being in non-contact with both of the inner wall surface 10*c* of the pipe 10 and the first liquid transfer unit 15 in a case of being viewed in the cross section of the pipe 10, which is orthogonal to the longitudinal direction Ld.

By being in non-contact with both of the inner wall surface 10*c* of the pipe 10 and the first liquid transfer unit 15, the second liquid transfer unit 16 has a large total surface area as not being in contact with other portions, and a space continuous along the longitudinal direction Ld is secured. In addition, the pipe 10 does not directly conduct heat received from an external thermal environment and does not conduct the heat via the first liquid transfer unit 15, so that the temperature thereof is estimated to tend to be kept in a relatively lower state than the first liquid transfer unit 15.

In addition, as shown in FIG. 1A, the second liquid transfer unit 16 at this time is arranged also in a state of existing along the longitudinal direction Ld of the inner wall surface 10*c* of the pipe 10.

Such a second liquid transfer unit 16 is formed of a material, such as a plurality of wire rods made of a metal, a bundle of a plurality of metal wires, and a metal net formed by crossing a plurality of metal wires into a net shape. Among the materials, the bundle of the plurality of metal wires includes, for example, a twisted bundle.

The second liquid transfer unit 16 of the first exemplary embodiment is formed by a linear material obtained by twisting and bundling up the plurality of metal wires. In addition, the second liquid transfer unit 16 made of the twisted linear material may be arranged to maintain a non-contact state with the inner wall surface 10*c* of the pipe 10 and the first liquid transfer unit 15, but is, for example, preferably configured such that the occupancy (=(S1/S2)× 100) of a cross-sectional area (a total area of cross-sectional areas of respective wire rods) S2 thereof with respect to a cross-sectional area S1 of the inside of the pipe 10 in the lateral direction Sd is 50% or less.

In addition, in a case where both of the first liquid transfer unit 15 and the second liquid transfer unit 16 are formed by using a material formed by a plurality of wire rods, for example, it is preferable to use ultrafine wire rods having a wire rod outer diameter of 0.06 mm or less. The first liquid transfer unit 15 and the second liquid transfer unit 16, which are formed by the plurality of ultrafine wire rods, have larger surface areas so that obtaining a capillary force is easier. In addition, for example, in a case of applying the small-diameter pipe 10, which is externally 3 mm or less, mounting work, such as work of putting the first liquid transfer unit 15 and the second liquid transfer unit 16, which are formed by the ultrafine wire rods, into the small-diameter pipe 10 is easy, which is effective.

Further, in a case where the first liquid transfer unit 15 and the second liquid transfer unit 16 are formed of a material formed by a plurality of wire rods, both end portions of the wire rods are fixed to both end portions 10*a* and 10*b* of the pipe 10. In addition, a method of bringing the first liquid transfer unit 15 into contact with the inner wall surface 10*c* of the pipe 10 via a contact assisting agent such as grease having thermal conductivity can be applied.

Next, a test performed to investigate the thermal conduction performance of the heat pipe 1 will be described.

Figure 2:
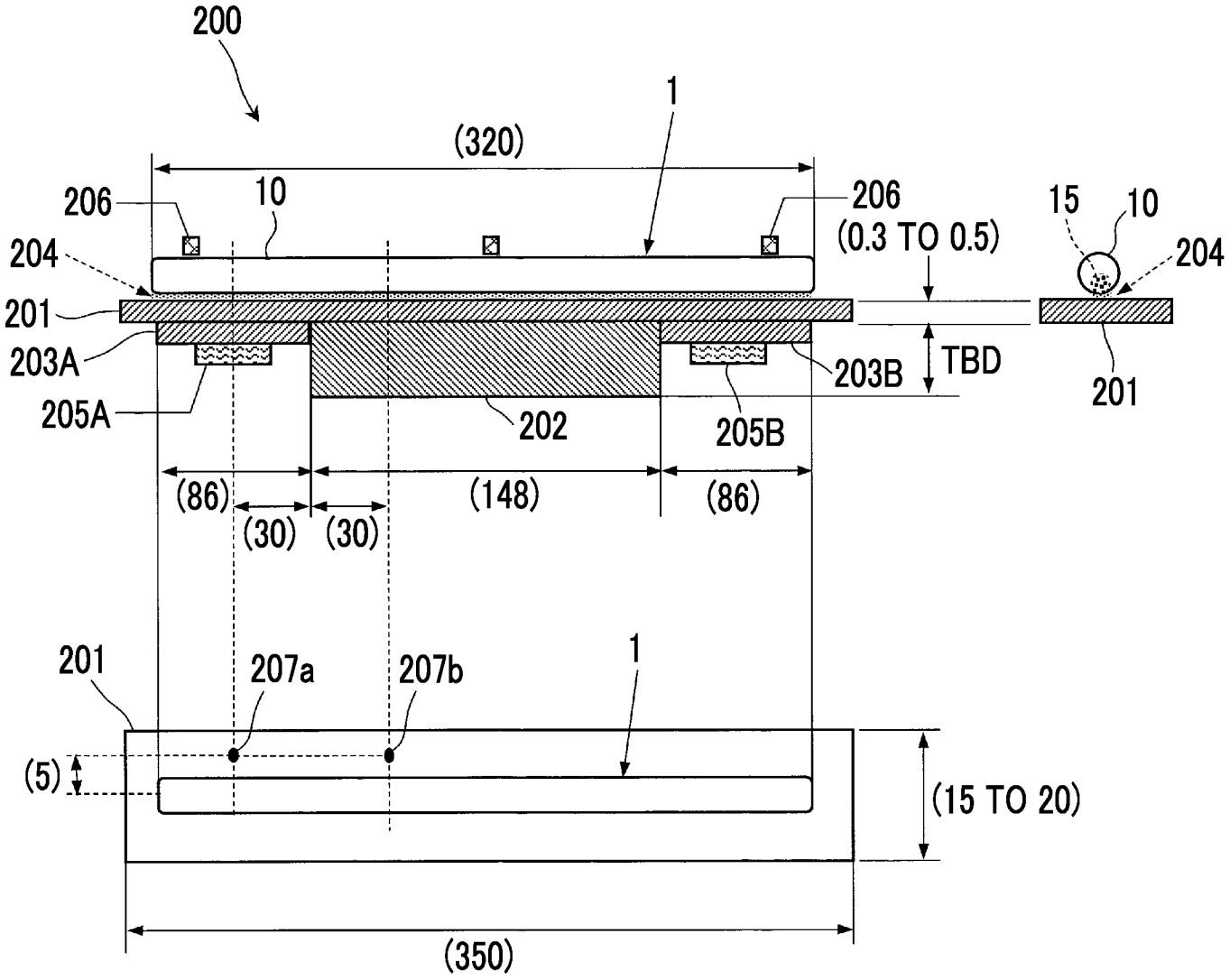
FIG. 2 is a schematic view showing a state where a measuring device used in an evaluation test is viewed from three directions.
Figure 3A:
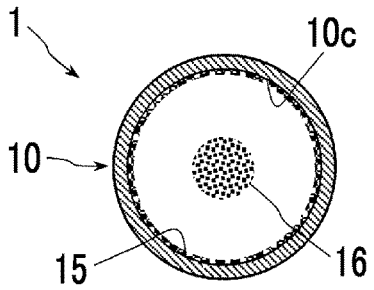
FIG. 3A is a cross sectional view showing a thermally conductive pipe of an example, which is used in the evaluation test.
Figure 3B:
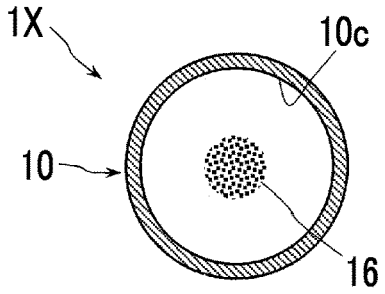
FIG. 3B is a cross sectional view showing a thermally conductive pipe of a comparative example, which is used in the evaluation test.

The test is, after a heat pipe configured as shown in FIG. 3A is prepared as the heat pipe 1 of an example and a heat pipe configured as shown in FIG. 3B is prepared as a heat pipe 1X of a comparative example, each of the heat pipes 1 and 1X is provided in a measuring device 200 shown in FIG. 2. Then, a temperature difference between two points in the vicinity of the heat pipes when the measuring device 200 is operated is measured as an evaluation indicator of the thermal conduction performance.

As the heat pipe 1 of the example, the oxygen-free copper pipe 10 (a length in the longitudinal direction Ld is 320 mm) having a shape, of which a thickness is in a range of approximately 0.1 to 0.2 mm in a circular cross section having an outer diameter in a range of 2 to 3 mm, is prepared in which the first liquid transfer unit 15 is arranged to be in contact with the entire circumference of the inner wall surface 10*c* of the pipe 10, and the second liquid transfer unit 16 is arranged to be in non-contact state with both of the inner wall surface 10*c* of the pipe 10 and the first liquid transfer unit 15, as shown in FIG. 3A.

As the first liquid transfer unit 15, a transfer unit made of a net-shaped material (a net thickness: 0.01 to 0.10 mm) made of a copper wire (wire diameter: 0.01 to 0.05 mm) is used. As the second liquid transfer unit 16, a transfer unit made of a material made of a linear material obtained by twisting 100 copper wires (wire diameter: 0.01 to 0.05 mm) is used.

The thermal capacity of the heat pipe 1 of the example is 1.35 (J/K). This thermal capacity is acquired using information obtained by measuring the specific heat, density, and volume of the heat pipe 1.

As the heat pipe 1X of the comparative example, the pipe 10 having the same configuration as the pipe 10 of the heat pipe 1 of the example is prepared, in which the first liquid transfer unit 15 is not arranged, and only the second liquid transfer unit 16 is arranged in a non-contact state with the inner wall surface 10*c* of the pipe 10, as shown in FIG. 3B. As the second liquid transfer unit 16, a material made of the same linear material as the second liquid transfer unit 16 of the heat pipe 1 of the example is used.

In addition, the thermal capacity of the heat pipe 1X of the comparative example is 1.5 (J/K). It is regarded that the thermal capacity of the heat pipe 1X of the comparative example is higher than the thermal capacity of the heat pipe 1 of the example due to a difference in density caused by a difference in the liquid transfer unit (wick).

As shown in FIG. 2, the measuring device 200 is configured by a measuring table 201 made of a rectangular aluminum plate, a heat radiating plate 202 that is arranged in a center portion of a lower surface of the measuring table 201 and is made of aluminum, heating plates 203A and 203B that are arranged on both ends sides of the lower surface of the measuring table 201 in the longitudinal direction, which are adjacent to the heat radiating plate 202, and are made of aluminum, heaters (planar heaters) 205A and 205B that are arranged on lower surfaces of the heating plates 203A and 203B, respectively, a pressing member 206 that presses and holds the heat pipe 1 against the measuring table 201, and thermocouples 207*a* and 207*b* that measure a temperature. The numerical values in parentheses in FIG. 2 indicate the dimensions (mm) of each of the configuring components.

The heat radiating plate 202 and the heating plates 203 are the same aluminum plates except that the thickness of the heat radiating plate 202 (TBD: 100 mm) is larger than the thickness of each heating plate 203.

In this test, measurements are made as follows.

First, as shown in FIG. 2, the heat pipes 1 and 1X to be measured are prepared by being provided on the measuring table 201 of the measuring device 200 in a state of facing the measuring table 201 in a posture where the first liquid transfer unit 15 is positioned at a lower most portion of the pipe 10. In this case, the heat pipes 1 and 1X are held by the measuring table 201 via grease 204 having thermal conductivity. For example, grease having thermal conductivity of 1 to 10 W/m/K is used as the grease 204.

Next, a first measured temperature from the thermocouple 207*b* on an inner side, which is on the inner side of an end portion of the measuring table 201, when the output of the heaters 205A and 205B is adjusted such that a measured temperature from the thermocouple 207*a* on an outer side, which is an end portion side of the measuring table 201, is stabilized at a first test temperature of 150° C., is obtained.

In addition, a second measured temperature from the thermocouple 207*b* on the inner side when the output of the heaters 205A and 205B is adjusted such that the measured temperature from the thermocouple 207*a* on the outer side is stabilized at a second test temperature of 230° C. is obtained.

Then, a value obtained by averaging a temperature difference between the first test temperature and the first measured temperature of one heat pipe 1 (or 1X) and a temperature difference between the second test temperature and the second measured temperature for a fixed period of time is acquired as a measured temperature difference (characteristic) of the heat pipe 1 (or 1X).

Figure 3C:
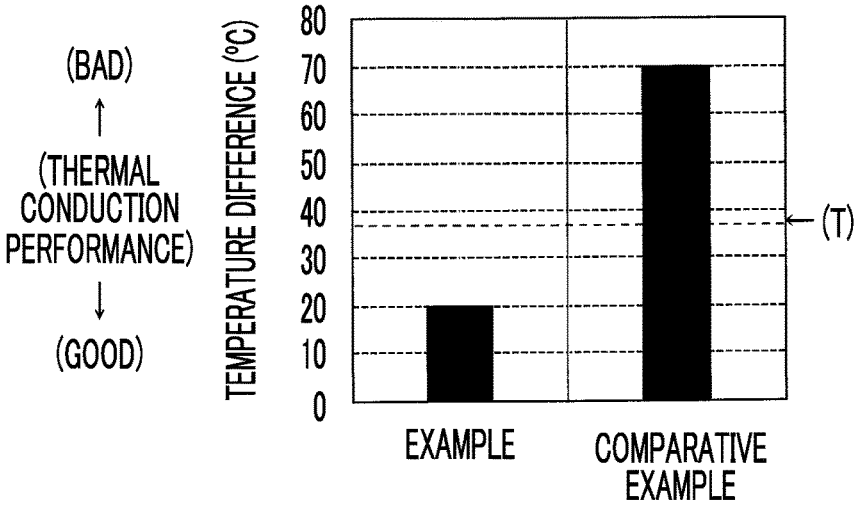
FIG. 3C is a graph showing results of the evaluation test.

FIG. 3C shows the measurement results of each of the heat pipes 1 and 1X. In addition, for example, it is desirable that heat conduction improves as the temperature difference decreases, but for example, 37° C. or lower is preferable as the allowable level of a temperature difference T.

From the results shown in FIG. 3C, the heat pipe 1 of the example satisfies the allowable level of the temperature difference T, which is 37° C. or lower. On the other hand, the heat pipe 1X of the comparative example does not satisfy the allowable level of the temperature difference T.

In addition, as the temperature difference measured in the test decreases, a temperature difference between a portion heated by the heater 205A and a non-heated portion on the inner side adjacent to the heated portion tends to decrease with improvement in heat movement (heat transfer) through the heat pipe, showing that the thermal conduction performance is good. On the contrary, as the measured temperature difference increases, heat movement through the heat pipe is not sufficiently performed, showing that the thermal conduction performance relatively has deteriorated. That is, the level of the temperature difference measured in this test has a correlation of indicating the quality of the thermal conduction performance in the longitudinal direction Ld of the heat pipe.

Therefore, from the test, it is recognized that the thermal conduction performance in the longitudinal direction Ld may be improved with the heat pipe 1 having the configuration of the example, compared to the heat pipe 1X of the comparative example.

That is, it is determined that in a case where the first liquid transfer unit 15 and the second liquid transfer unit 16 are arranged as in the heat pipe 1 of the example, a temperature difference may be prevented and the thermal conduction performance in the longitudinal direction Ld is improved, compared to the heat pipe 1X of the comparative example in which only the second liquid transfer unit 16 is arranged.

Modification Example of First Exemplary Embodiment

Figure 4A:
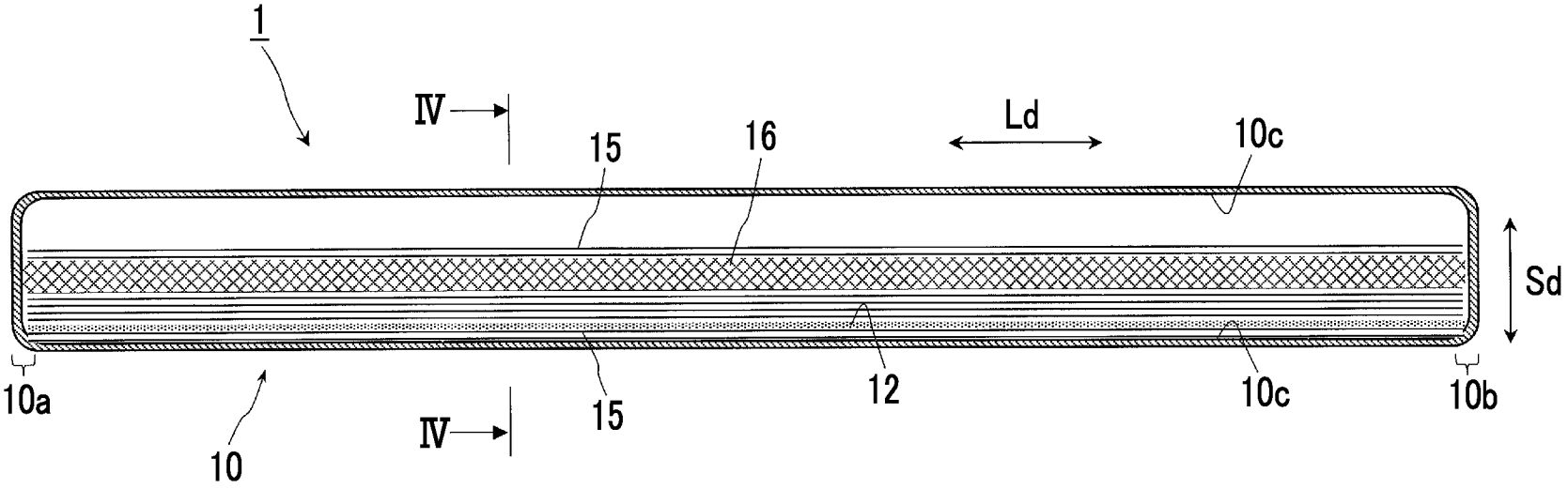
FIG. 4A is a schematic cross sectional view taken along a longitudinal direction of a thermally conductive pipe according to a modification example of the first exemplary embodiment.
Figure 4B:
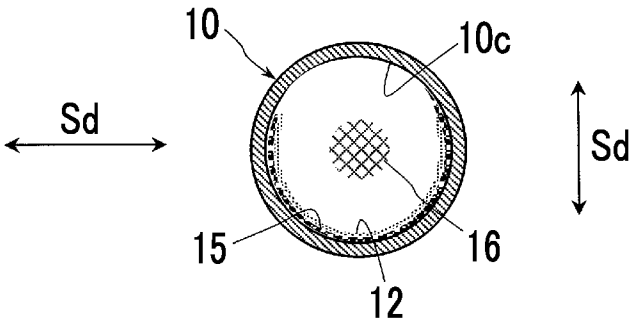
FIG. 4B is a schematic cross sectional view of the thermally conductive pipe of FIG. 4A taken along line IV-IV.

As shown in FIGS. 4A and 4B, in the heat pipe 1 according to the first exemplary embodiment, the first liquid transfer unit 15 may be arranged to be in contact with a part of the inner wall surface 10*c* of the pipe 10 in the circumferential direction.

As shown in FIG. 4A, the first liquid transfer unit 15 at this time is arranged in a state of existing along the longitudinal direction Ld inside the pipe 10. In the heat pipe 1, the second liquid transfer unit 16 may be formed of, for example, a net-shaped material.

The heat pipe 1 of this modification example is used in a state where a portion where the first liquid transfer unit 15 is arranged is brought into contact with a portion to which heat is to be moved.

In addition, the same test has been performed also on the heat pipe 1 of the modification example, and results showing almost the same tendency has been obtained.

Second Exemplary Embodiment

Figure 5:
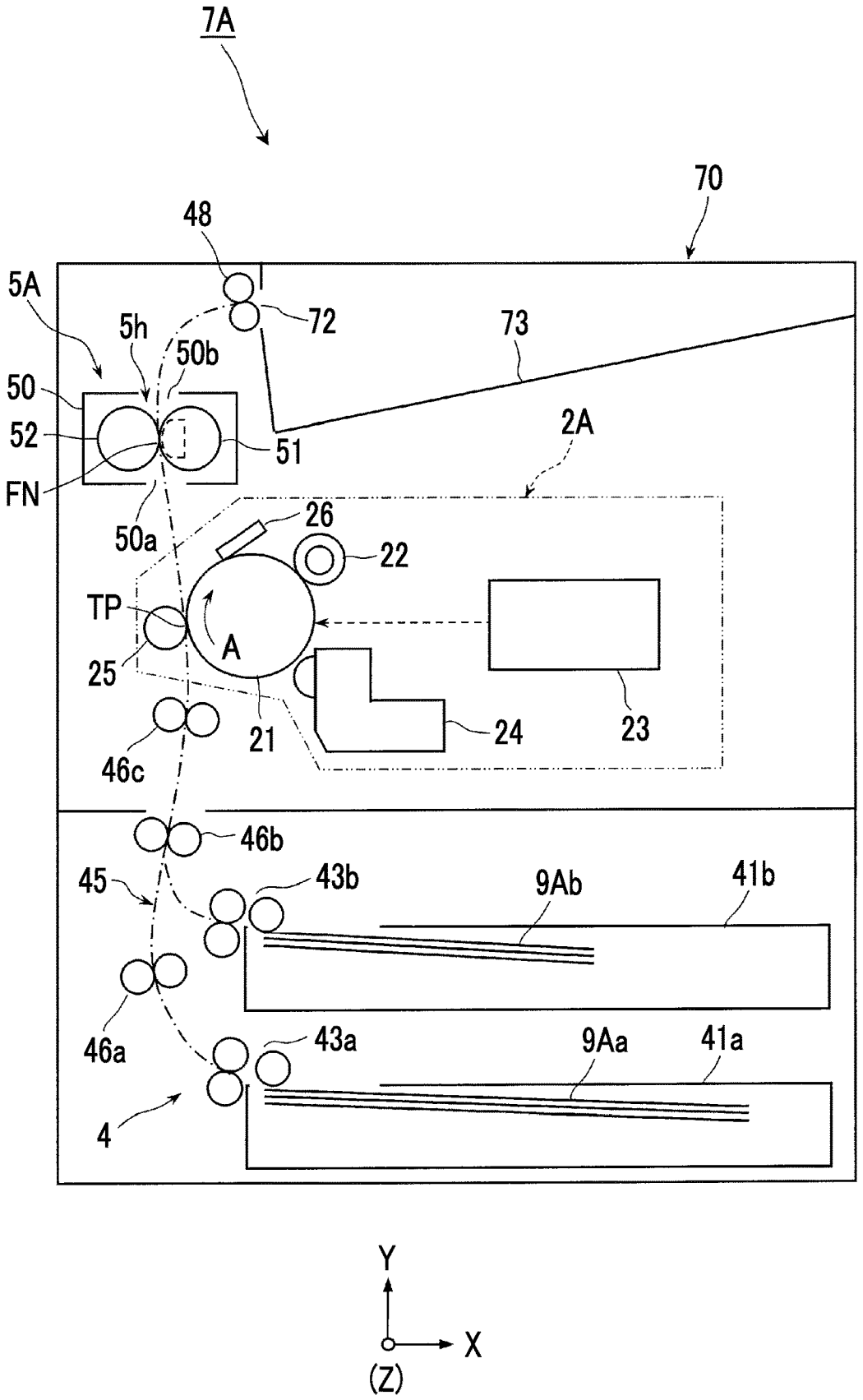
FIG. 5 is a schematic view showing an inside of a treatment system according to a second exemplary embodiment.
Figure 6:
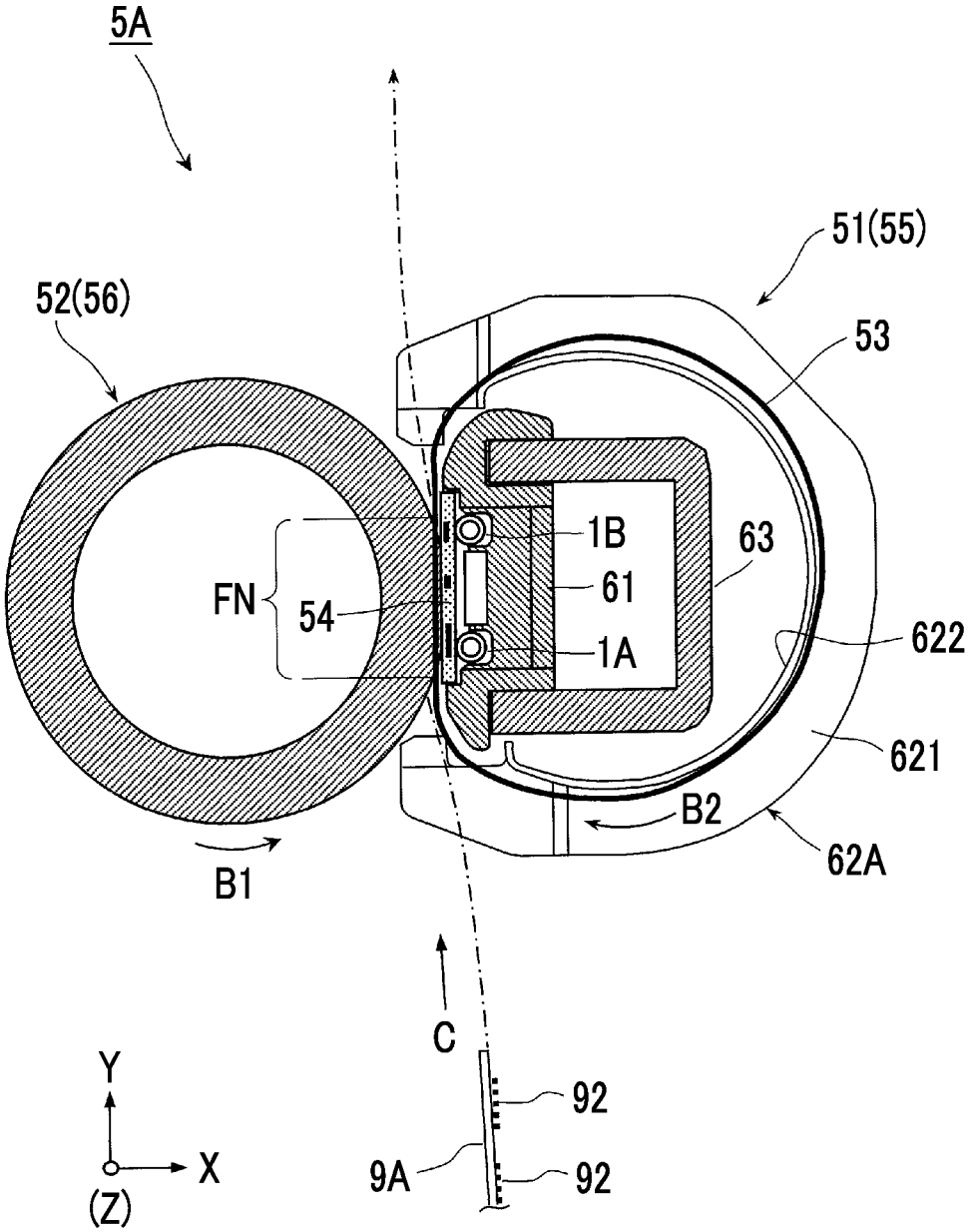
FIG. 6 is a schematic view showing an inside of a heat treatment device according to the second exemplary embodiment.

FIGS. 5 and 6 show a configuration example related to a second exemplary embodiment. FIG. 5 shows a treatment system 7 according to the second exemplary embodiment. FIG. 6 shows a heat treatment device 5 according to the second exemplary embodiment.

In the following description, a direction indicated by an arrow X in the drawings is a width direction of the device, a direction indicated by an arrow Y is a height direction of the device, and a direction indicated by an arrow Z is a depth direction of the device orthogonal to each of the width direction and the height direction. A circle attached to an intersection of the arrow X and the arrow Y in the drawings indicates that the depth direction of the device (arrow Z) faces a lower side orthogonal to the drawings.

The treatment system 7 includes the heat treatment device 5 that has a heat treatment unit, which exchanges heat with an object to be treated 9 passing through the heat treatment unit while being in contact therewith, and another treatment device 2 that performs other treatment on the object to be treated 9 before passing through or after passing through the heat treatment device 5, other than the heat exchange.

In addition, the heat treatment device 5 includes a heat treatment unit 5*h* that exchanges heat with the object to be treated 9 which passes through the heat treatment unit while being in contact therewith and the heat pipe 1 that is provided over a portion corresponding to a passing region E1, through which the object to be treated 9 passes, and a portion corresponding to a non-passing region E2, through which the object to be treated 9 does not pass, in the heat treatment unit 5*h*.

In the second exemplary embodiment, an image forming device 7A that performs treatment of forming an image on the object to be treated 9 is applied as an example of the treatment system 7. In addition, since the treatment system 7 is the image forming device 7A in the second exemplary embodiment, a heating device 5A having the heat treatment unit that performs heat exchange of heating the object to be treated 9 is applied as an example of the heat treatment device 5, an image generating device 2A that generates an image, which is other treatment on the object to be treated 9 before passing through the heating device 5A, other than heating treatment, is applied as an example of another treatment device 2, and a recording sheet 9A on which an image is formed is applied as an example of the object to be treated 9.

Treatment System

The image forming device 7A, which is an example of the treatment system 7, is a device that forms an image by forming an image made from a developer, which is an example of powder, on the recording sheet 9A and then heating and fixing the image.

As shown in FIG. 5, the image forming device 7A has a housing 70 formed in a required external shape, and is configured by arranging the image generating device 2A, a sheet supplying device 4, and the heating device 5A in an internal space of the housing 70. A one-dot chain line in FIG. 5 indicates a major transport path when the recording sheet 9A is transported in the housing 70.

The image generating device 2A is a device that forms a toner image formed from a toner, which is a developer, and transfers the toner image to the recording sheet 9A. The image generating device 2A has a photosensitive drum 21 that rotates in a direction indicated by an arrow A, and is configured by arranging devices, including a charging device 22, an exposure device 23, a developing device 24, a transfer device 25, and a cleaning device 26, around the photosensitive drum 21.

Among the components, the photosensitive drum 21 is an example of an image holding unit, and is a photoreceptor made into a drum shape having a photosensitive layer serving as an image forming surface and an image holding surface. The charging device 22 is a device that charges an outer circumferential surface (image forming surface) of the photosensitive drum 21 to a required surface potential. The charging device 22 is configured to include a charging member formed, for example, in a roller shape, which is brought into contact with the image forming surface, that is the outer circumferential surface of the photosensitive drum 21, and to which a charging current is supplied.

The exposure device 23 is a device that exposes the charged outer circumferential surface of the photosensitive drum 21 based on image information to form an electrostatic latent image. The exposure device 23 operates by receiving an image signal which is generated as an image treatment unit (not shown), to which the image information is externally input, executes required treatment. The image information is, for example, information related to an image to be formed, such as text, figures, pictures, and patterns. The developing device 24 is a device that develops the electrostatic latent image formed on the outer circumferential surface of the photosensitive drum 21 with a developer (toner) having a predetermined corresponding color (for example, black) to make the electrostatic latent image visible as a monochromatic toner image.

Next, the transfer device 25 is a device that electrostatically transfers a toner image formed on the outer circumferential surface of the photosensitive drum 21 to the recording sheet 9A. The transfer device 25 is configured to include a transferring member formed in a roller shape, which is brought into contact with the outer circumferential surface of the photosensitive drum 21, and to which a transferring current is supplied. The cleaning device 26 is a device that removes unnecessary substances such as an unnecessary toner and powder adhered to the outer circumferential surface of the photosensitive drum 21 and cleans the outer circumferential surface of the photosensitive drum 21.

A part of the image generating device 2A, in which the photosensitive drum 21 and the transfer device 25 face each other, is a transfer position TP where the transfer of the toner image is performed.

The sheet supplying device 4 is a device that accommodates and sends out the recording sheet 9A to be supplied to the transfer position TP in the image generating device 2A. The sheet supplying device 4 is configured by arranging a single or a plurality of accommodating bodies 41 accommodating the recording sheet 9A and a single or a plurality of sending devices 43 sending out the recording sheet 9A.

The accommodating body 41 is an accommodating member having a loading plate (not shown) that loads and accommodates a plurality of recording sheets 9A in a required direction. The sending device 43 is a device that feeds out the recording sheets 9A loaded on the loading plate of the accommodating body 41 one by one with devices including a plurality of rollers. The sheet supplying device 4 of the second exemplary embodiment has, for example, two accommodating bodies 41*a* and 41*b* that can individually accommodate recording sheets 9Aa and 9Ab having different widths at the time of transporting and two sending devices 43*a* and 43*b* that individually send out the recording sheets 9Aa and 9Ab that are accommodated in the accommodating bodies 41*a* and 41*b* respectively.

The sheet supplying device 4 is connected to the transfer position TP in the image generating device 2A by a supply transport path 45, which is an example of a transport unit. The supply transport path 45 is a transport path through which the recording sheet 9A (9Aa or 9Ab) sent out from the sheet supplying device 4 is transported and supplied to the transfer position TP, and is configured by arranging a plurality of transport rollers 46*a* and 46*b* that transport the recording sheet 9A with the recording sheet sandwiched therebetween and a plurality of guide members (not shown) that secure a transport space for the recording sheet 9A and guide the transporting of the recording sheet 9A.

In addition, the recording sheet 9A may be a sheet-shaped recording medium, which can be transported in the housing 70 and to which a toner image can be transferred and fixed by heat, and a material and a shape thereof are not particularly restricted.

The heating device 5A is a device that performs treatment of heating and pressurizing in order to fix a toner image, which is a non-fixed image transferred at the transfer position TP in the image generating device 2A, to the recording sheet 9A by heat. The heating device 5A is configured by arranging devices, such as a heating rotating body 51 and a pressurizing rotating body 52, in an internal space of a housing 50 provided with an introduction port 50*a* and a discharge port 50*b* for the recording sheet 9A.

In addition, as shown in FIGS. 5 and 6, in the heating device 5A, the heating rotating body 51 and the pressurizing rotating body 52 are arranged to rotate while being in contact with each other, and the recording sheet 9A passing through that contact portion FN is heated and pressurized. In the heating device 5A, a portion configured by the heating rotating body 51 and the pressurizing rotating body 52 is the heat treatment unit 5*h*.

Details of the heating device 5A will be described later.

For example, the image forming device 7A forms an image as follows.

That is, in the image forming device 7A, in a case where a control unit (not shown) receives a command of an operation of forming an image, the image generating device 2A performs a charging operation, an exposing operation, a developing operation, and a transferring operation while the sheet supplying device 4 performs an operation of sending out the required recording sheet 9A (9Aa or 9Ab) and transporting and supplying the recording sheet to the transfer position TP via the supply transport path 45.

Accordingly, a toner image corresponding to image information is formed on the photosensitive drum 21 while the toner image is transferred to the recording sheet 9A supplied from the sheet supplying device 4 to the transfer position TP. In addition, in this case, the recording sheet 9A to which the toner image is transferred is peeled from the photosensitive drum 21 in a state of being sandwiched between the rotating photosensitive drum 21 and the transfer device 25 and is sent out toward the heating device 5A.

Next, as shown in FIG. 6, in the image forming device 7A, the heating device 5A performs a fixing operation of heating and pressurizing in a case where the recording sheet 9A, on which a toner image 92 is transferred, has been introduced and has passed through the contact portion FN. Accordingly, a non-fixed toner image 92 melts under pressurization and is fixed to the recording sheet 9A. In this case, the heating rotating body 51 and the pressurizing rotating body 52 function as a transport unit that transports the recording sheet 9A.

After being discharged from the housing 50 in a state of being sandwiched between the heating rotating body 51 and the pressurizing rotating body 52 of the heating device 5A, the recording sheet 9A after fixing is transported to a discharge port 72 via a discharge transport path, and is sent out by a discharge roller 48 to a sheet accommodating unit 73 provided in a part of the housing 70 so as to be accommodated therein in the end.

As described hereinbefore, a basic image forming operation of the image forming device 7A of forming a monochromatic image on one side of one recording sheet 9A is completed.

Heat Treatment Device

Next, the heating device 5A, which is an example of the heat treatment device 5, will be described in detail.

Figure 7:
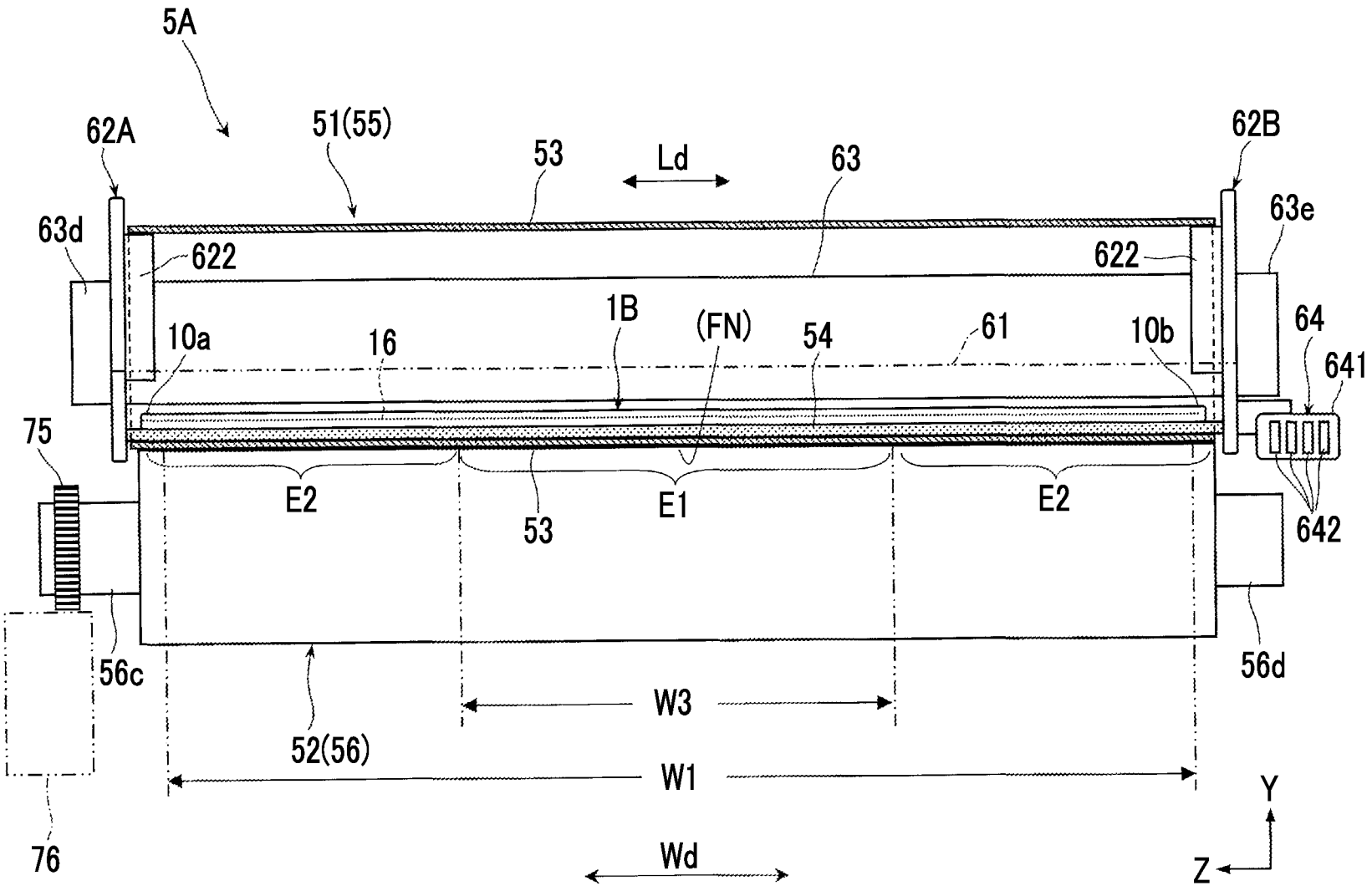
FIG. 7 is a schematic view showing a state where the heat treatment device of FIG. 6 is viewed from another direction in a partial cross section.

As shown in FIGS. 6 and 7, in the heating device 5A according to the second exemplary embodiment, a belt-nip type heating unit 55 formed by a heating belt 53 that is capable of rotating and a heat generating body 54 that is an example of a heating portion, which generates heat to perform heating by forming the contact portion (nip) FN obtained by pressing the heating belt 53 against the pressurizing rotating body 52 from an inner circumferential surface thereof, is applied as the heating rotating body 51, and a pressurizing roller 56 having a roller shape is applied as the pressurizing rotating body 52.

Among the components, the heating unit 55 performs heat treatment of heating the recording sheet 9A at the contact portion FN in a passing width direction Wd (FIG. 7) intersecting a transport direction C of the recording sheet 9A.

The heating unit 55 is configured to hold the heat generating body 54 in a state of being brought into contact with the inner circumferential surface of the heating belt 53 with a contact holding body 61, and to rotatably hold the heating belt 53 with a part of the contact holding body 61 and right and left end portion holding bodies 62A and 62B. In addition, the heating unit 55 supports the contact holding body 61 and the right and left end portion holding bodies 62A and 62B with a support body 63.

The heating belt 53 is an endless belt for heat conduction having flexibility and heat resistance. For example, a belt, which is formed by using a material such as a synthetic resin, including polyimide and polyamide, such that the original shape is a cylindrical shape, is applied as the heating belt 53.

As shown in FIGS. 8A to 9B, the heat generating body 54 is configured by a substrate 541, a plurality of (three, in the present example) heat generating units 542A, 542B, and 542C that are provided on one side 541*a* of the substrate 541, which is in contact with the inner circumferential surface of the heating belt 53, and a wiring unit 543 for supplying power to the heat generating units 542A, 542B, and 542C.

The substrate 541 is a member that has a rectangular plate shape having a size, that is, a width size W in the passing width direction Wd intersecting the transport direction C of the recording sheet 9A, which is longer than a maximum width size W1. The substrate 541 is made of a material having electrical insulation, and for example, a ceramic substrate is applied. After providing the heat generating units 542A, 542B, and 542C, a coating layer is formed to coat the surface (one side) 541*a* of the substrate 541, which is on a side in contact with the inner circumferential surface of the heating belt 53.

Figure 9A:
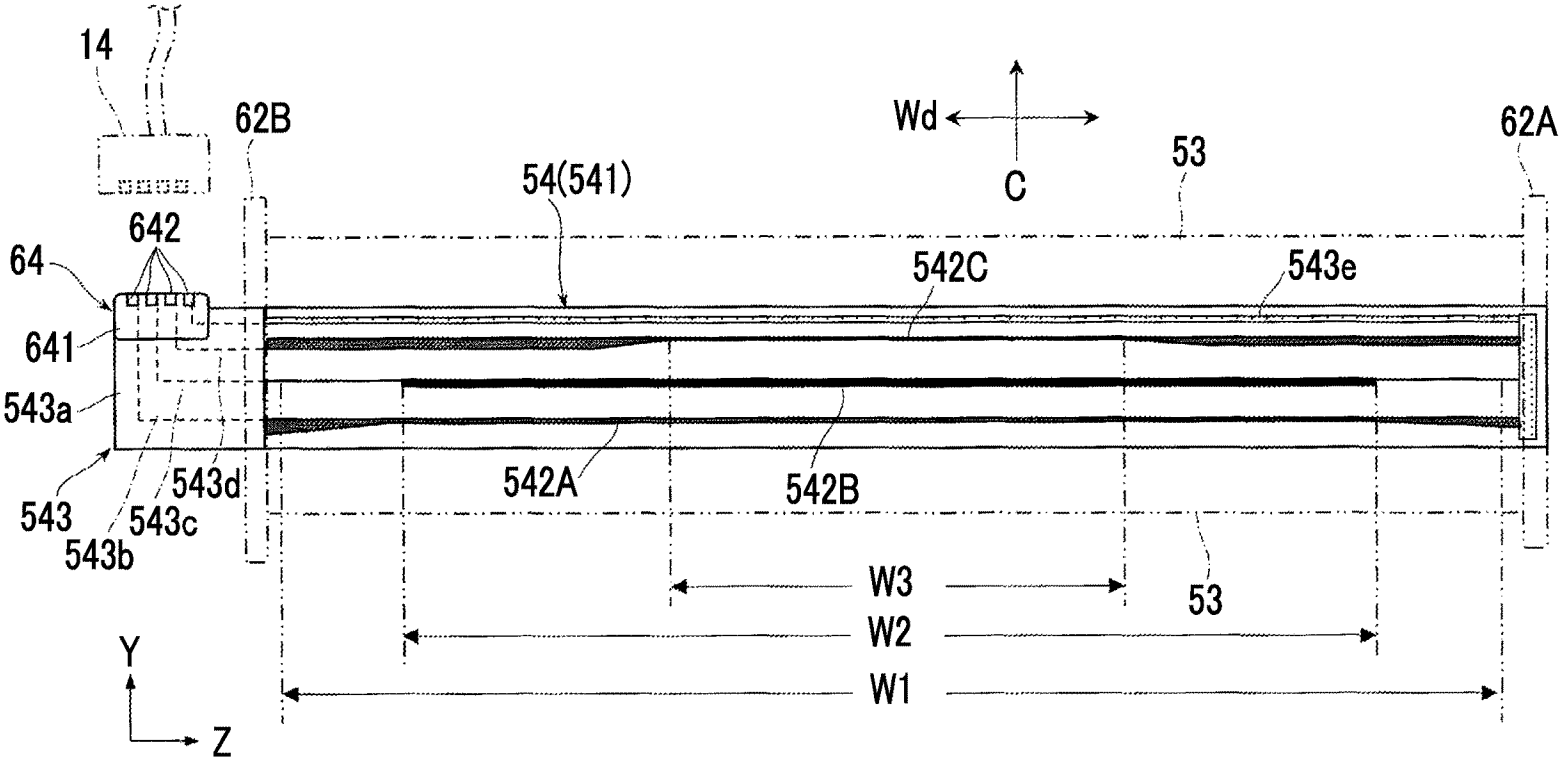
FIG. 9A is a schematic view showing a part of the heating unit of FIGS. 8A and 8B.

As shown in FIG. 9A, the heat generating units 542A, 542B, and 542C are heating wire units that are provided in a linear shape to follow the one side 541*a* of the substrate 541 in a longitudinal direction thereof (a direction along the passing width direction Wd of the recording sheet 9A) and to be in a parallel state where the heat generating units are spaced apart from each other in the passing width direction Wd of the recording sheet 9A.

Since FIG. 9A is a drawing showing a state viewed from a back side (the other surface) 541*b* of the one side 541*a* of the substrate 541 of the heat generating body 54, the heat generating unit 542 provided on the side of the one side 541*a* does not practically appear. However, for convenience of describing the heat generating unit 542, the heat generating unit 542 is shown in a state of being seen through from the other surface 541*b* in FIG. 9A.

In addition, the heat generating units 542A, 542B, and 542C have almost the same length in the longitudinal direction of the substrate 541, but are configured such that regions generating a relatively large amount of heat exist at positions different from each other so as to be adapted to a difference in the width size W when transporting the recording sheet 9A.

That is, as shown in FIG. 9A, the first heat generating unit 542A is configured such that a center portion is a region that generates a large amount of heat excluding end portions on both end sides in the longitudinal direction. The first heat generating unit 542A is used when the recording sheet 9A of which the width size W is an intermediate width size W2 (<W1) passes therethrough. In addition, the second heat generating unit 542B is configured such that portions corresponding to the end portions of the first heat generating unit 542A on both end sides are regions that generate a large amount of heat. Further, the third heat generating unit 542C is configured such that a center portion (for example, a portion approximately ⅓ of the total length) in the longitudinal direction is a region that generates a large amount of heat. The third heat generating unit 542C is used when the recording sheet 9A of which the width size W is a minimum size W3 (<W2) passes therethrough.

That is, configurations of the regions of the heat generating units 542A, 542B, and 542C of the second exemplary embodiment, which generate a relatively large amount of heat, include a case of adopting a central reference transporting method (center registration method) in which a center position in the recording sheet 9A in the passing width direction Wd at the time of transporting is transported by guiding to pass through, for example, a center position of the contact portion FN of the heating device 5A with a passing region width of the recording sheet 9A as reference.

In addition, the regions of the heat generating units 542A, 542B, and 542C, which generate a relatively large amount of heat, can be realized by making, for example, the heating wire units at least one of narrower or thinner or both of narrower and thinner than other portions (portions preventing heat generation) and making an electric resistance value relatively high.

Further, the temperature of the heat generating body 54 caused by heat generation by the heat generating units 542A, 542B, and 542C is measured by a temperature sensor (not shown) arranged to be in contact with a necessary place of the other surface 541*b* of the substrate 541 of the heat generating body 54, and the measurement information is fed back to a heating control unit (not shown).

As shown in FIG. 9A, the wiring unit 543 is provided such that a line concentration portion thereof exists at one end portion of the heat generating body 54 in the longitudinal direction at a position on the outer side of any one of the end portion holding bodies 62A and 62B. The wiring unit 543 of the second exemplary embodiment is configured as an end portion obtained by extending one end portion of the substrate 541 to the outer side of the right end portion holding body 62B.

In addition, the wiring unit 543 is configured by a substrate 543*a* having electrical insulation, individual wiring units 543*b*, 543*c*, and 543*d* individually connected to one end portions of the heat generating units 542A, 542B, and 542C respectively as shown by dashed lines in FIG. 9A, and a common wiring unit 543*e* connected commonly to each of other end portions of the heat generating units 542A, 542B, and 542C as shown by a halftone dot portion and a dashed line in FIG. 9A.

Figure 9B:
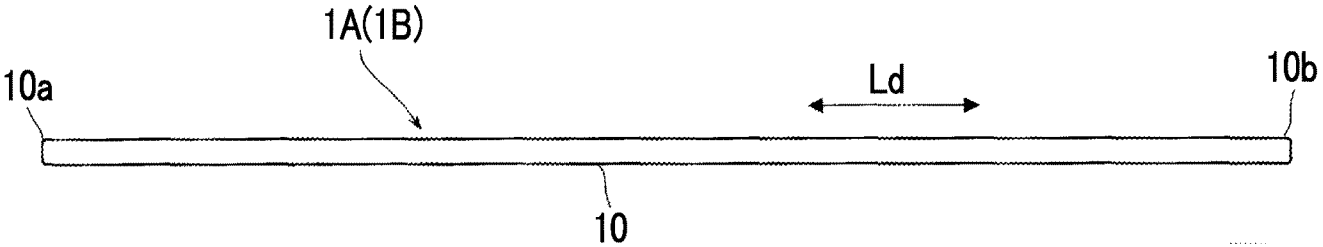
FIG. 9B is a schematic view showing the thermally conductive pipe.

As shown in FIGS. 9A and 9B, the heat generating body 54 is connected to a supply power connection unit 64 that supplies power to the wiring unit 543 and thus the heat generating unit 542.

The supply power connection unit 64 of the second exemplary embodiment is configured by a housing (connector body) 641 made in an attachable and detachable shape for connection and a plurality of contact terminals 642 provided on one side surface of the housing 641 in a state of being connected to a connecting end portion of each wiring of the wiring unit 543 and being exposed.

For example, as shown in FIG. 9A, the supply power connection unit 64 is connected to a power supply connection unit 14, which extends from a power supply unit (not shown) of the image forming device 7A and is routed, and comes into a state that can be energized.

Figure 8A:
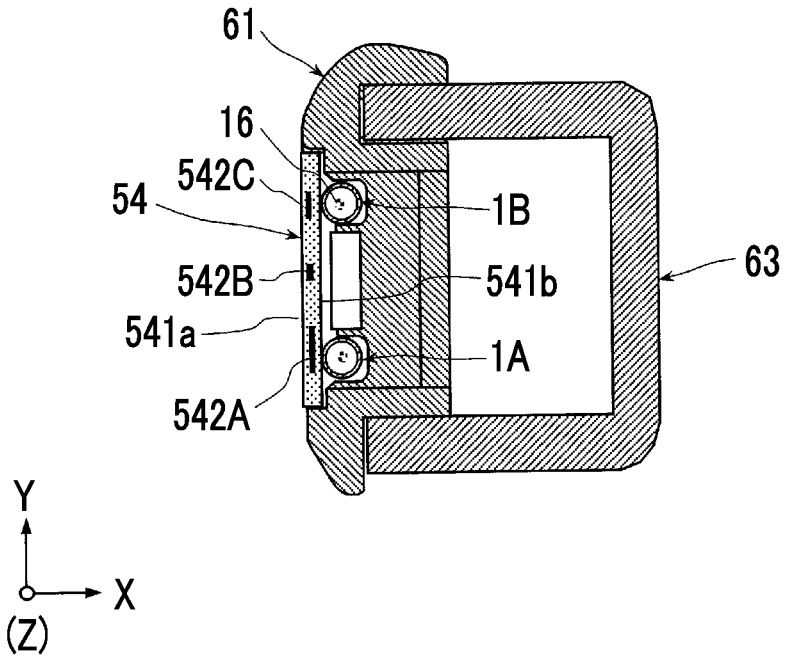
FIG. 8A is a schematic cross sectional view showing a part of a heating unit applied to the heat treatment device of FIG. 6.
Figure 8B:
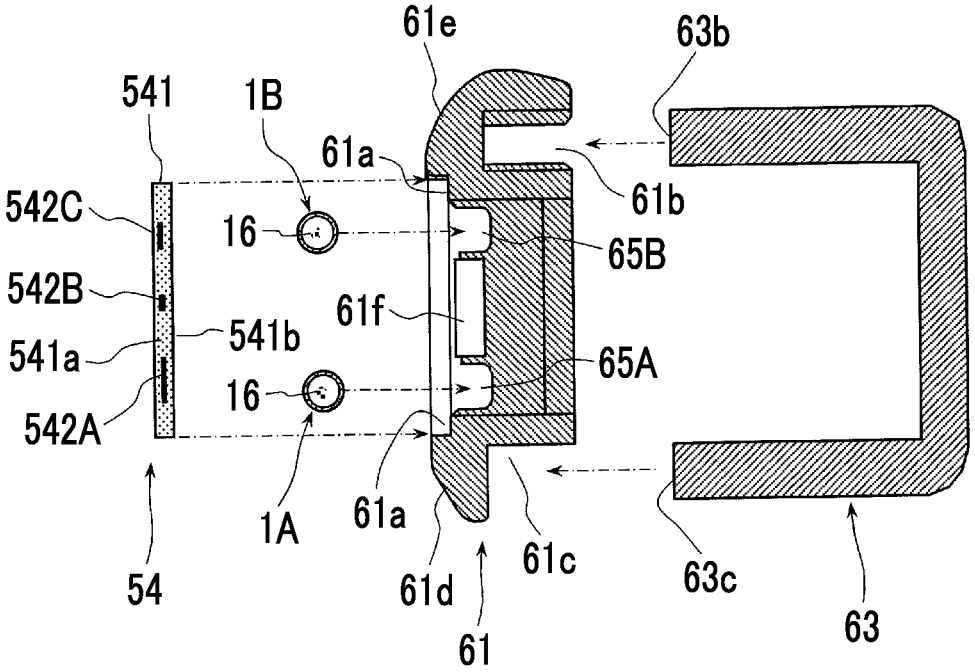
FIG. 8B is an exploded view of the heating unit of FIG. 8A.

As shown in FIG. 8B, the contact holding body 61 is a plate-shaped member that is provided with an accommodating recessed portion 61*a*, which accommodates and holds the heat generating body 54, on one side on a side being brought into contact with the inner circumferential surface of the heating belt 53, and is long in one direction.

In addition, the contact holding body 61 is provided with a mounting groove portion 61*b* and a mounting contact portion 61*c*, which are used when mounting on the support body 63, on the other surface on an opposite side to the one side.

Further, in the contact holding body 61, one long side end portion of the one side where the accommodating recessed portion 61*a* is provided is formed as an introduction guide portion 61*d*, which is made of a bent surface guiding the heating belt 53 so as to be introduced into the contact portion FN, and the other long side end portion of the one side is formed as an extracting guide portion 61*e*, which is made of a curved surface guiding the heating belt 53 in a direction being extracted from the contact portion FN.

Both of the right and left end portion holding bodies 62A and 62B each are a member provided, on an inner surface of a disk-shaped body 621 of which a portion facing the pressurizing roller 56 is partially missing, with a curved guide holding portion 622 that guides and holds both end portions of the heating belt 53 in the width direction so as to be able to rotate from the inner circumferential surface thereof. In addition, the right and left end portion holding bodies 62A and 62B each are provided, on the inner side of the guide holding portion 622 of the body 621, with a mounting recessed portion (not shown) mounted on an end portion of the support body 63.

As shown in FIG. 7, the support body 63 is a member longer than the length of the heat generating body 54 in the longitudinal direction. As shown in FIGS. 8A and 8B, for example, a member that has a shape in which long side end portions of a flat plate, which is long in one direction, are folded almost at a right angle in the same direction such that the cross section has a recessed shape, is applied as the support body 63.

In a case of mounting the contact holding body 61, as shown in FIG. 8B, the support body 63 is kept in a state where one folded end portion 63*b* is fitted into the mounting groove portion 61*b* of the contact holding body 61 while the other folded end portion 63*c* is brought into contact with the mounting contact portion 61*c* of the contact holding body 61. Accordingly, the support body 63 supports a part of the contact holding body 61 in a state of being sandwiched in the longitudinal direction.

As the pressurizing roller 56, which is the pressurizing rotating body 52, for example, an outer circumferential surface of a columnar or cylindrical roller base made of a metal, which is provided with an elastic body layer and a release layer, is applied.

As shown in FIG. 7, the pressurizing roller 56 is rotatably supported by a pressurizing mechanism (not shown) in which shaft portions 56*c* and 56*d* at both end portions in an axial direction thereof are arranged on the housing 50. In addition, the pressurizing roller 56 receives a pressure so as to be pressed against the heating unit 55 from the pressurizing mechanism. Accordingly, as shown in FIGS. 6 and 7, the pressurizing roller 56 is kept in a state where a roller outer circumferential surface thereof is in pressure-contact at a required pressure in the longitudinal direction of the one side 541*a* of the heat generating body 54 via the heating belt 53 of the heating unit 55.

A portion of the pressurizing roller 56, which is in pressure-contact with the heating unit 55, is the contact portion FN.

In addition, as shown in FIG. 7, in the pressurizing roller 56, a power passive gear 75, which is an example of a drive input unit, is mounted on one shaft portion 56*c* thereof, and the power passive gear 75 is meshed with a power transmission gear (not shown) of a drive transmission device 76 arranged on a housing 70 side of the image forming device 7A. Accordingly, in a case where a timing when an image forming operation becomes necessary comes, the pressurizing roller 56 is rotated and driven at a required speed in a direction indicated by an arrow B1 as a rotational force is transmitted and input from the drive transmission device 76, as shown in FIG. 6.

When the pressurizing roller 56 is rotated and driven, the heating belt 53 of the heating unit 55 rotates in a direction indicated by an arrow B2, as shown in FIG. 6.

In addition, the heating device 5A is configured such that a heat generating region of the heat generating body 54 of the heating unit 55 is adjusted depending on a difference in the width size W of the recording sheet 9A passing through the contact portion FN in a case of performing an image forming operation.

For example, when the recording sheet 9A of which the width size W at the time of transporting is the maximum width size W1 passes through, power is supplied to both of the first heat generating unit 542A and the second heat generating unit 542B, causing a region corresponding to the maximum width size W1 to generate heat. In addition, when the recording sheet 9A having the minimum size W3 passes through, power is supplied only to the third heat generating unit 542C, causing a region corresponding to the minimum size W3 to generate heat. Further, when the recording sheet 9A having the intermediate width size W2 passes through, power is supplied only to the first heat generating unit 542A, causing a region corresponding to the intermediate width size W2 to generate heat.

Accordingly, the heating device 5A adapts the heat generating body 54 of the heating unit 55 to a difference in the width size W of the recording sheet 9A, efficiently generating heat.

On the other hand, for example, in a case of heating the recording sheet 9A having the width size W (a size including the intermediate width size W2 and the minimum size W3)

smaller than the maximum width size W1 by causing the recording sheet to continuously pass through the heating device 5A as well, the non-passing region E2 that is a region, through which the recording sheet 9A does not pass, is generated in the contact portion FN (practically the heat generating body 54). For this reason, the non-passing region E2 is likely to come into a state where the temperature has risen since the non-passing region is continuously heated from a portion where heat generation by the heat generating unit 542 is prevented without the passing recording sheet 9A taking away heat.

In this case, a portion of the heat generating body 54, which corresponds to the non-passing region E2, has a relatively high temperature compared to the passing region E1 through which the recording sheet 9A passes, causing a temperature difference. As a result, in a case where the recording sheet 9A having a large width size is caused to pass and be heated after then, heating unevenness is induced, and the contact holding body 61 is locally heated and is adversely affected in some cases.

Figure 10:
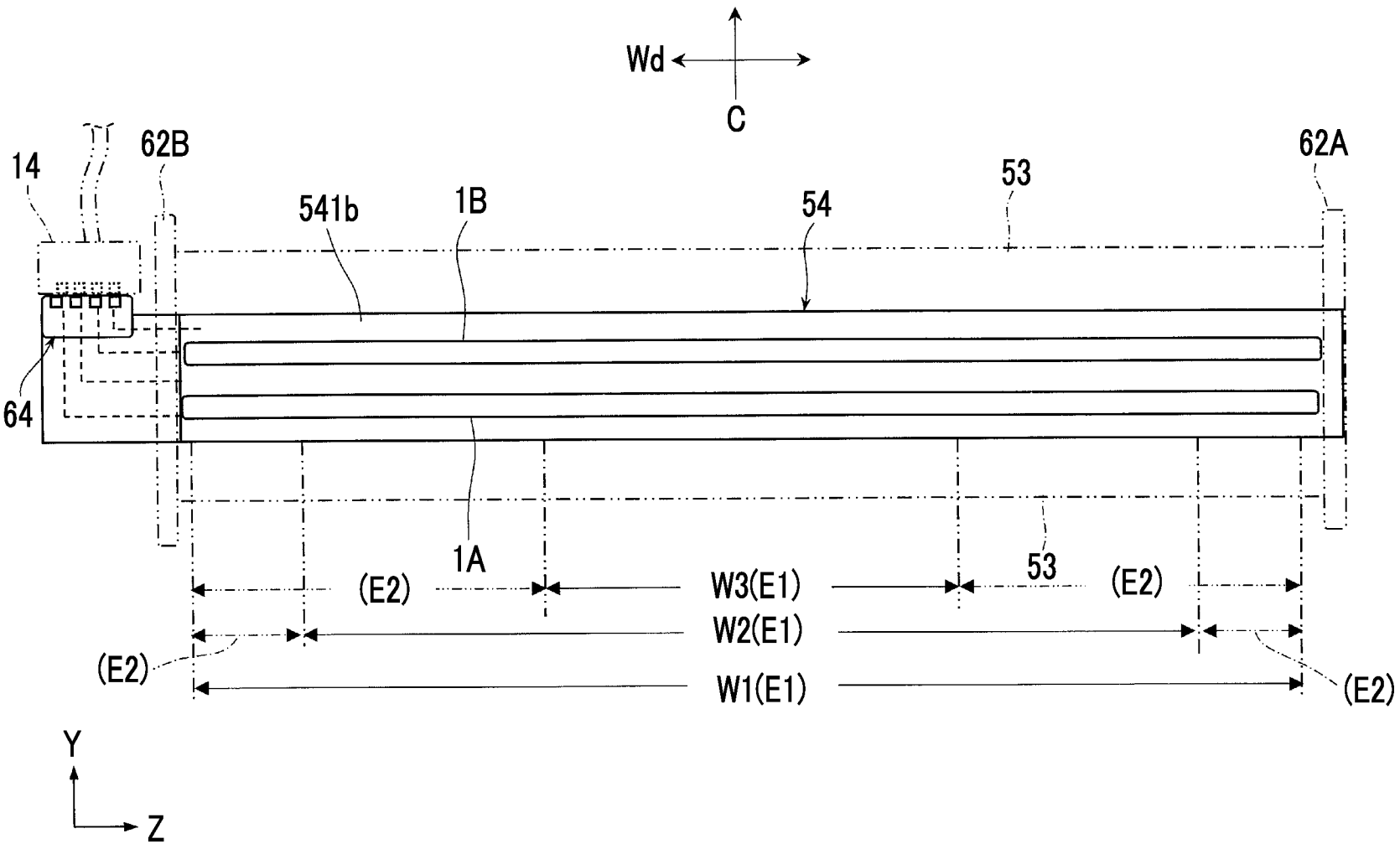
FIG. 10 is a schematic view showing a part of the heating unit of FIGS. 8A and 8B.

That is, in a case where heat treatment described above is performed by the heating device 5A, the heat generating body 54 of the heat treatment unit 5*h* of the heating device 5A comes into a state where an unnecessary temperature difference has occurred between the passing region E1 through which the recording sheet 9A passes and the non-passing region E2 for the recording sheet 9A, as shown in FIGS. 7 and 10. In this case, the portion of the heat generating body 54, which corresponds to the non-passing region E2, has a risen temperature at the time of heat treatment and becomes a high temperature portion which brings about a temperature difference while a portion of the heat generating body 54, which corresponds to the passing region E1, has a temperature relatively lower than the portion (high temperature portion) corresponding to the non-passing region E2 at the time of heat treatment and becomes a low temperature portion which brings about a temperature difference.

Thus, from a perspective of preventing the occurrence of a temperature difference caused by an unnecessary rise in the temperature of the portion (high temperature portion) of the heat generating body 54, which corresponds to the non-passing region E2, two heat pipes 1A and 1B are arranged in the heating device 5A in a state of being in contact with the surface (back side) 541*b* on an opposite side to the surface 541*a* on the side in contact with the heating belt 53 of the heat generating body 54 of the heating unit 55, as shown in FIGS. 6, 7, and 10. Herein, the high temperature portion is a portion that causes approximately a temperature at which the working liquid 12 sealed in the heat pipes 1A and 1B is at least vaporized, and is a portion that has, for example, a temperature of 150° C. or higher.

The heat pipe 1 having the configuration according to the first exemplary embodiment is applied to both of the heat pipes 1A and 1B.

In addition, as shown in FIGS. 9A and 9B, the heat pipes 1A and 1B have almost the same length as the length of the heat generating unit 542 of the heat generating body 54. Further, since the two heat pipes are arranged in a state of being arranged in parallel with each other at a place where a provision space is restricted, heat pipes having a relatively small diameter (for example, an outer diameter is in a range of 2 to 3 mm) are applied as the heat pipes 1A and 1B.

As shown in FIGS. 7 and 10, the heat pipes 1A and 1B are arranged in a state of being in contact with the other surface 541*b* of the heat generating body 54 along the longitudinal direction (the direction along the passing width direction Wd of the recording sheet 9A) and being parallel to the transport direction C of the recording sheet 9A at a required interval.

The following arrangement is adopted in the second exemplary embodiment. That is, as shown in FIGS. 8A and 8B, first, the mounting grooves 65A and 65B for mounting the heat pipes 1A and 1B are provided in the accommodating recessed portion 61*a* of the contact holding body 61, and the heat pipes 1A and 1B are mounted to be accommodated in the mounting grooves 65A and 65B, respectively. Next, by accommodating the heat generating body 54 in the accommodating recessed portion 61*a* of the contact holding body 61, the heat pipes 1A and 1B are kept in a state of being pressed in the mounting grooves 65A and 65B by coming into contact with the other surface 541*b* of the heat generating body 54. The heat pipes 1A and 1B may be fixed to the other surface 541*b* of the heat generating body 54 by partially being adhered thereto with a material, such as an adhesive and grease that have thermal conductivity.

In addition, as shown in FIG. 7, the heat pipes 1A and 1B are arranged in the heating device 5A in a state of being in contact with a portion (the low temperature portion in a case where there is the non-passing region E2) corresponding to the passing region E1, through which the recording sheet 9A having the maximum width size W1 passes, including at least the portion (high temperature portion) of the heat generating body 54 of the heat treatment unit 5*h*, which corresponds to the non-passing region E2. In a state where the second liquid transfer unit 16 is not in contact with both of the inner wall surface 10*c* of the pipe 10 and the first liquid transfer unit 15, the heat pipes 1A and 1B at this time are configured to be arranged in a region in contact with the portion corresponding to the passing region E1 through which the recording sheet 9A having the maximum width size W1 passes, including the portion (high temperature portion) corresponding to the non-passing region E2.

Further, in the heating device 5A, the heat pipes 1A and 1B are arranged such that the first liquid transfer unit 15 comes into a state of being in contact with a portion of the inner wall surface 10*c* (FIGS. 1A and 1B) inside the pipe 10, which faces the heat generating body 54.

Thus, in the heating device 5A in which the heat pipes 1A and 1B are arranged, even in a case where the portion of the heat generating body 54 in the contact portion FN, which corresponds to the non-passing region E2, through which the recording sheet 9A does not pass, is generated and the temperature rises, the heat of the portion of the heat generating body 54, which corresponds to the non-passing region E2, is moved to the portion (low temperature portion) corresponding to the passing region E1 for the recording sheet 9A, which is in a state of having relatively lower temperature than the portion (high temperature portion) corresponding to the non-passing region E2, due to the action of heat movement of the heat pipes 1A and 1B.

In this case, in the heat pipes 1A and 1B, in brief, heat moves as follows.

For example, both of the heat pipes 1A and 1B conduct heat to the portion of the pipe 10 in contact with the portion (high temperature portion) of the heat generating body 54, which corresponds to the non-passing region E2 for the recording sheet 9A, and the working liquid 12 which is inside the portion of the pipe 10 is heated and vaporized. In this case, the corresponding portions of the heat pipes 1A and 1B take away heat required for vaporization and absorb the heat. Then, due to a rise in the temperature and the pressure with the vaporization (generally evaporation), the vaporized working liquid 12 moves toward a portion where the temperature and the pressure are relatively low inside the pipe 10. The portion of the pipe 10 at this time, in which the temperature and the pressure are relatively low, is a portion positioned on a center side of the pipe 10 in contact with the portion (low temperature portion) of the heat generating body 54, which corresponds to the passing region E1 for the recording sheet 9A.

On the other hand, in the portion of the pipe 10 in contact with the portion (low temperature portion) of the pipe 10, which corresponds to the passing region E1 for the recording sheet 9A, the vaporized working liquid 12 (steam) is condensed and liquefied as being cooled. In this case, in the corresponding portions of the heat pipes 1A and 1B, the heat of condensation generated by liquefaction is released to dissipate the heat. Then, due to the capillary force of the first liquid transfer unit 15, the liquefied working liquid 12 moves almost along the longitudinal direction Ld of the pipe 10 to the portion (high temperature portion) in contact with the portion corresponding to the non-passing region E2 for the recording sheet 9A.

By repeating the operations described above in the heat pipes 1A and 1B, heat is moved from the portion of the pipe 10, of which the temperature is relatively high, to the portion of the pipe, of which the temperature is relatively low, almost along the longitudinal direction Ld of the pipe 10. Accordingly, also in the heat generating body 54 that is in contact with the heat pipes 1A and 1B, the heat of the portion corresponding to the non-passing region E2 (high temperature portion) moves to the portion corresponding to the passing region E1 for the recording sheet 9A (low temperature portion), exchanging heat.

Figure 11A:
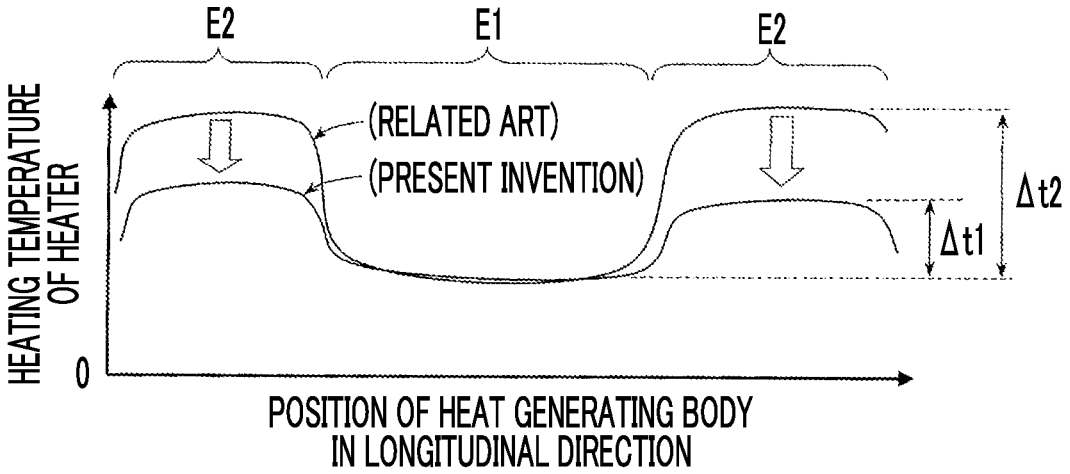
FIG. 11A is a graph showing a state of heating in a longitudinal direction of a heating device of each of the exemplary embodiment of the present invention and the related art.

As a result, compared to a case (the related art) where the heat pipes 1A and 1B are not arranged, the temperature of the non-passing region E2 is prevented from rising higher than the temperature of the passing region E1, and a temperature difference Δt that occurs at the heat generating body 54 configuring a fundamental portion of the heat treatment unit 5*h* is prevented in the heating device 5A, as shown in FIG. 11A. The temperature difference Δt is at least an unnecessary temperature difference.

In particular, since the first liquid transfer unit 15 is arranged in a state of being in contact with the inner wall surface 10*c* inside the pipe 10 in the heat pipes 1A and 1B, the pipe 10 quickly conducts received heat to the first liquid transfer unit 15, the working liquid 12 adhered to or near the first liquid transfer unit 15 is likely to be vaporized, and also the vaporized working liquid 12 is likely to move through a space existing between the first liquid transfer unit 15 and the second liquid transfer unit 16. In addition, since the second liquid transfer unit 16 is arranged in a state of not being in contact with both of the inner wall surface 10*c* inside the pipe 10 and the first liquid transfer unit 15, the pipe 10 conducts received heat slow to the second liquid transfer unit compared to the first liquid transfer unit 15 while keeping the temperature relatively low. Thus, the vaporized working liquid 12 (steam) is quickly liquefied in a case of being touched by the second liquid transfer unit 16, and the working liquid 12 is also likely to be transferred by the capillary force of the second liquid transfer unit 16.

For this reason, in the heat pipes 1A and 1B, the circulation of the working liquid 12 inside the pipe 10 is efficiently performed, and heat is also efficiently moved.

Accordingly, a temperature difference that occurs in the passing width direction Wd of the heat generating body 54 of the heat treatment unit 5*h*, that is, an unnecessary temperature difference that occurs in the heat generating body 54 between the high temperature portion corresponding to the non-passing region E2 and the low temperature portion corresponding to the passing region E1 is efficiently prevented in the heating device 5A. In particular, an image made from a toner is heated, for example, in a range of 150° C. to 230° C. by the heat generating body 54 in order to heat and melt the image so as to be fixed well to the recording sheet 9A in the heating device 5A, but the unnecessary temperature difference is effectively prevented despite the fact that the heat pipes 1A and 1B having a relatively small diameter, which are described above, are applied also to such an unnecessary temperature difference that occurs at the heat generating body 54. It is clear also from the results of the test that the temperature difference prevention effect is obtained.

Therefore, even in a case where the recording sheet having the width size W (W1 or W2) relatively larger than the recording sheet 9A having the small width size W (W2 or W3) is caused to pass to perform heating treatment after continuously causing the recording sheet 9A having the width size W (the size including the intermediate width size W2 and the minimum size W3) smaller than the maximum width size W1 to pass, heating, in which the occurrence of heating temperature variations attributable to an unnecessary temperature difference is low, can be performed in the heating device 5A.

In addition, even in a case where the recording sheet having the width size W (W1 and W2), which is relatively larger than the recording sheet 9A having the small width size W (W2 and W3), is used to form an image after the recording sheet 9A having the width size W (W2 and W3) which is relatively small is continuously used, a toner image formed by the image generating device 2A is fixed well in the image forming device 7A through heating by the heating device 5A, in which the occurrence of heating temperature variations attributable to an unnecessary temperature difference is low. Accordingly, a homogeneous image with low fixing unevenness (heating unevenness) attributable to the unnecessary temperature difference is obtained by the image forming device 7A.

Warm-up time, which is time required for heating to a predetermined temperature when power is supplied to the heating device 5A, is investigated. The measurement of the warm-up time is performed as the measuring device 200, in which a fundamental portion (heat generating body 54) of the heat treatment unit 5*h* of the heating device 5A is simulated, measured time required to become 200° C., which is the predetermined temperature from the thermocouple 207*a* (FIG. 2) on the outer side. In addition, for comparison, the same measurement is performed using the heat pipe 1X of the comparative example.

Figure 11B:
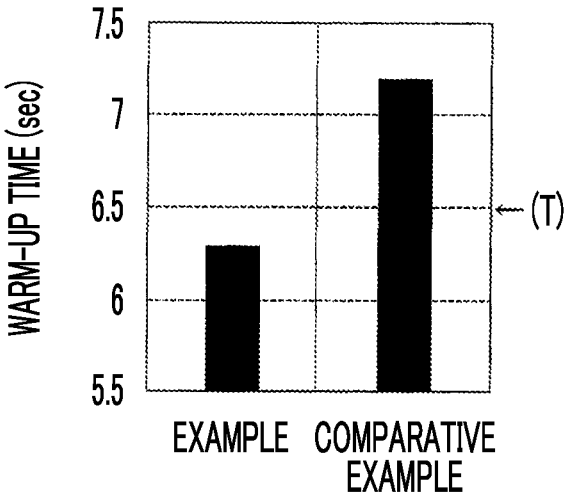
FIG. 11B is a graph showing warm-up time of the heating device using the thermally conductive pipe of each of the example and the comparative example.

FIG. 11B shows measurement results at this time.

From the results shown in FIG. 11B, it can be seen that warm-up time can be shortened in a case of using the heat pipe 1 of the example, compared to a case of using the heat pipe 1X of the comparative example.

Consequently, in addition to obtaining the effect of preventing the temperature difference (Δt) (FIG. 3C), an effect of shortening the warm-up time is also obtained with the heating device 5A.

Modification Example of Second Exemplary Embodiment

Figure 12A:
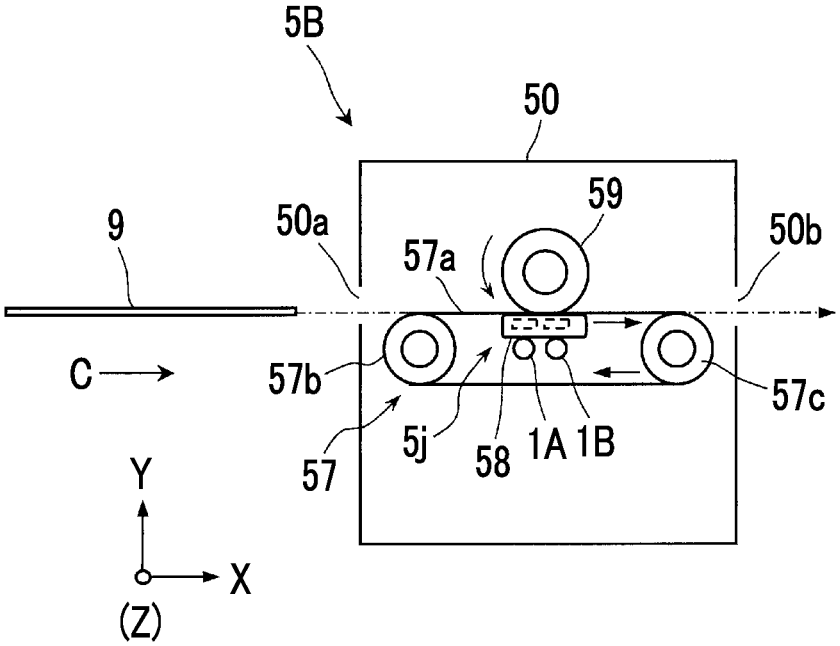
FIG. 12A is a schematic view showing an inside of a cooling device according to a modification example of the second exemplary embodiment.
Figure 12B:
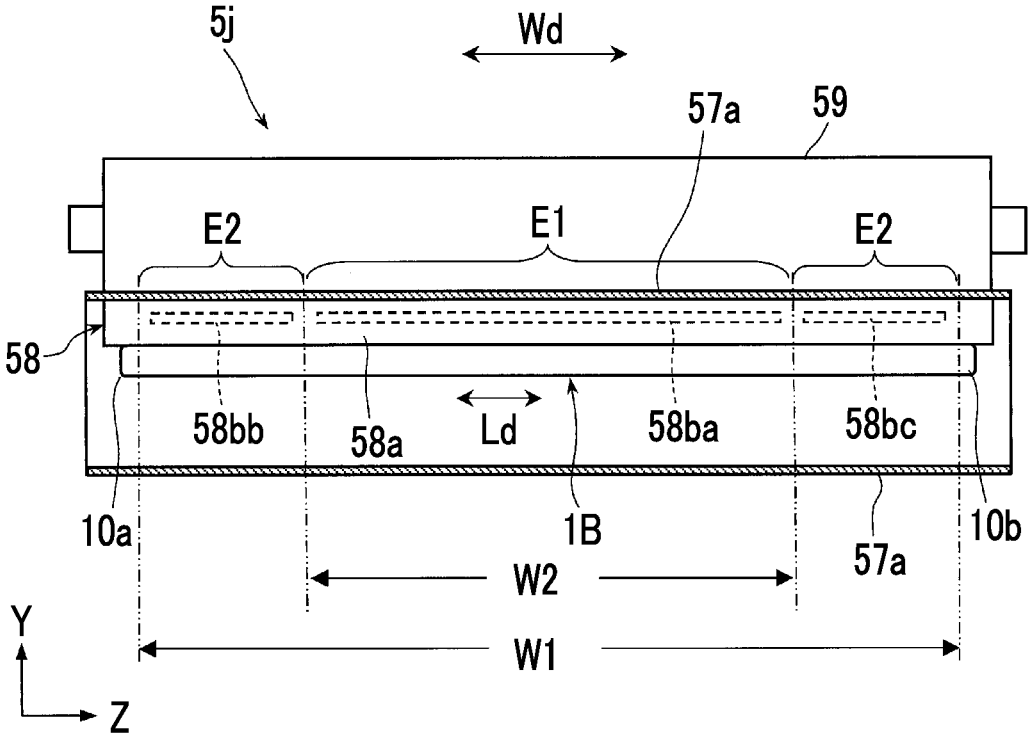
FIG. 12B is a schematic view showing a part of the cooling device of FIG. 12A in a partial cross section.

Although the heating device 5A has been given as an example of the heat treatment device 5 in the second exemplary embodiment, for example, also a cooling device 5B including a heat treatment unit 5*j* that performs heat exchange of cooling the passing object to be treated 9 while being in contact therewith may be the heat treatment device 5, as shown in FIGS. 12A and 12B.

The cooling device 5B is configured by arranging devices, including a transport device 57 for the object to be treated 9, a cooling unit 58, which is an example of the heat treatment unit 5*j* cooling the object to be treated 9 transported by the transport device 57, and a pressing rotating body 59, which presses the object to be treated 9 against the cooling unit 58, in an internal space of the housing 50, in which the introduction port 50*a* and the discharge port 50*b* for the object to be treated 9 are provided.

In particular, as the object to be treated 9, for example, a sheet-shaped or plate-shaped object to be cooled is applied. In the cooling device 5B, for example, the object to be treated 9, of which the width size W is the maximum width size W1, and the object to be treated, which has the intermediate width size W2 smaller than the maximum width size W1, are targeted.

For example, a belt transport type device is used as the transport device 57. Specifically, the transport device 57 is configured by an endless transport belt 57*a* that has thermal conductivity, support rollers 57*b* and 57*c* that hang and rotate the transport belt 57*a* in a direction indicated by an arrow to support the transport belt, and a drive device (not shown) that transmits a rotational power to one of the support rollers 57*b* and 57*c*.

For example, a pressing rotating body having a roller shape is used as the pressing rotating body 59. The pressing rotating body 59 is arranged such that the transport belt 57*a* of the transport device 57 is driven to rotate while being pressed against the cooling unit 58.

The cooling unit 58 is configured as a treatment unit that performs cooling by being arranged in a state of being in contact with an inner surface of the transport belt 57*a* of the transport device 57. Specifically, the cooling unit is configured by a support body 58*a* that has thermal conductivity and cooling bodies 58*b* that continuously send or circulate a cooling medium (a gas or a liquid) (not shown) to the support body 58*a* through a pipe and a passage along the passing width direction Wd of the object to be treated 9. A portion of the cooling unit 58, which is in contact with the inner surface of the transport belt 57*a*, functions as a major cooling unit.

The support body 58*a* is a member having a long shape, which is longer than the maximum width size W1 of the object to be treated 9 along the passing width direction Wd. The cooling bodies 58*b* each are a cooling unit that is provided in a linear shape to follow a longitudinal direction (the direction along the passing width direction Wd of the recording sheet 9A) of the support body 58*a* and to be in a parallel state of being spaced apart from each other in the passing width direction Wd of the object to be treated 9. In addition, the cooling bodies 58*b* are connected to a device (not shown) that generates and sends the cooling medium.

The cooling device 5B cools the object to be treated 9 in a case where the object to be treated 9 transported by the transport belt 57*a* of the transport device 57 passes through the cooling unit 58. In this case, the object to be treated 9 passes through in a state of being pressed toward the cooling unit 58 by the pressing rotating body 59.

Then, for example, in a case of cooling the object to be treated 9 having the width size W (intermediate width size W2) smaller than the maximum width size W1 by causing the object to be treated to continuously pass through the cooling device 5B as well, the non-passing region E2 that is a region, through which the object to be treated 9 does not pass, is generated in the cooling unit 58. For this reason, heat is absorbed due to cooling at the time of heat treatment and the temperature rises in the portion of the cooling unit 58, which corresponds to the passing region E1 through which the object to be treated 9 passes, while a state where the temperature is low is likely to be caused in the portion, which corresponds to the non-passing region E2 for the object to be treated 9, since heat is not absorbed due to cooling at the time of heat treatment.

In this case, the portion of the cooling unit 58, which corresponds to the passing region E1, has a relatively high temperature while the portion corresponding to the non-passing region E2 has a locally low temperature, causing a temperature difference in the cooling unit 58 as a whole. As a result, in a case where the object to be treated 9 having the large width size W (W1) is caused to pass and be cooled after then, cooling unevenness is induced in some cases.

That is, in a case where heat treatment of cooling described above is performed in the cooling device 5B, the cooling unit 58, which is the heat treatment unit 5*j*, comes into a state where an unnecessary temperature difference has occurred between the portion corresponding to the passing region E1 for the object to be treated 9 and the portion corresponding to the non-passing region E2 for the object to be treated 9, as shown in FIG. 12B. In this case, the portion of the cooling unit 58, which corresponds to the passing region E1 for the object to be treated 9, has a risen temperature and becomes the high temperature portion which brings about a temperature difference while the portion of the cooling unit 58, which corresponds to the non-passing region E2, has a temperature relatively lower than the portion (high temperature portion) corresponding to the passing region E1 and becomes the low temperature portion which brings about a temperature difference.

Thus, from a perspective of preventing an unnecessary temperature difference that occurs between the portion (high temperature portion) of the cooling unit 58, which corresponds to the passing region E1 for the object to be treated 9, and the portion (low temperature portion) corresponding to the non-passing region E2 for the object to be treated 9, the two heat pipes 1A and 1B are arranged also in the cooling device 5B in a state of being in contact with a surface (back side) of the cooling unit 58 on an opposite side to a surface on a side in contact with the transport belt 57*a*, as shown in FIGS. 12A and 12B. Herein, the high temperature portion is a portion that causes approximately a temperature at which the working liquid 12 sealed in the heat pipes 1A and 1B is at least vaporized, and is a portion that has, for example, a temperature of 100° C. or higher.

The heat pipe 1 having the configuration according to the first exemplary embodiment is applied to both of the heat pipes 1A and 1B.

In addition, as shown in FIG. 12B, the heat pipes 1A and 1B are arranged in the cooling device 5B in a state of being in contact with the portion of the cooling unit 58 of the heat treatment unit 5*j*, which corresponds to the passing region E1 through which the object to be treated 9 having at least the maximum width size W1 passes. Also in the heat pipes 1A and 1B at this time, the second liquid transfer unit 16 is arranged in a non-contact state with both of the inner wall surface 10*c* of the pipe 10 and the first liquid transfer unit 15.

Thus, in the cooling device 5B in which the heat pipes 1A and 1B are arranged, even in a case where the portion of the cooling unit 58 that comes into contact with the object to be treated 9 (via the transport belt 57*a*), which corresponds to the non-passing region E2 for the object to be treated 9, is generated and a temperature difference occurs, the heat of the portion of the cooling unit 58, which corresponds to the passing region E1, is moved to the portion (low temperature portion) corresponding to the non-passing region E2 for the object to be treated 9, which is in a state of having a relatively lower temperature than the portion (high temperature portion) corresponding to the passing region E1, due to the action of heat movement of the heat pipes 1A and 1B, exchanging heat.

As a result, compared to a case where the heat pipes 1A and 1B are not arranged, the temperature of the passing region E1 is prevented from rising when the portion corresponding to the non-passing region E2 for the object to be treated 9 is generated, and an unnecessary temperature difference that occurs at the cooling unit 58 is prevented in the cooling device 5B.

In addition, also in the cooling device 5B, even in a case where the cross-sectional area S1 of the pipe 10 in the lateral direction Sd decreases, the thermal conduction performance of the heat pipes 1A and 1B in the longitudinal direction Ld improves, and the occurrence of cooling unevenness attributable to the unnecessary temperature difference is prevented.

In addition, for example, a drying device including the heat treatment unit 5*h* that performs heat treatment of drying the object to be treated 9 and the heat pipe 1, such as a heat pipe arranged in a portion of the heat treatment unit 5*h*, which is to prevent a temperature difference that occurs in the passing width direction Wd of the object to be treated 9, may be adopted as another example of the heat treatment device 5. The heat treatment of drying at this time is heat treatment of heating.

Further, the heat pipe 1 which is represented by a heat pipe arranged in the heat treatment device 5 may be the heat pipe 1 (FIG. 4A) having the configuration described in the modification example of the first exemplary embodiment. In addition, the number of heat pipes 1 arranged in the heat treatment device 5 is not limited to two, may be one, or may be three or more. The transport device 57 arranged in the heat treatment device 5 may be a transport device under a transport method other than the belt transport type.

In addition, although the image forming device 7A including the image generating device 2A and the heating device 5A is given as an example of the treatment system 7 in the second exemplary embodiment, an image forming device having other configurations may be adopted as the treatment system 7.

Figure 13A:
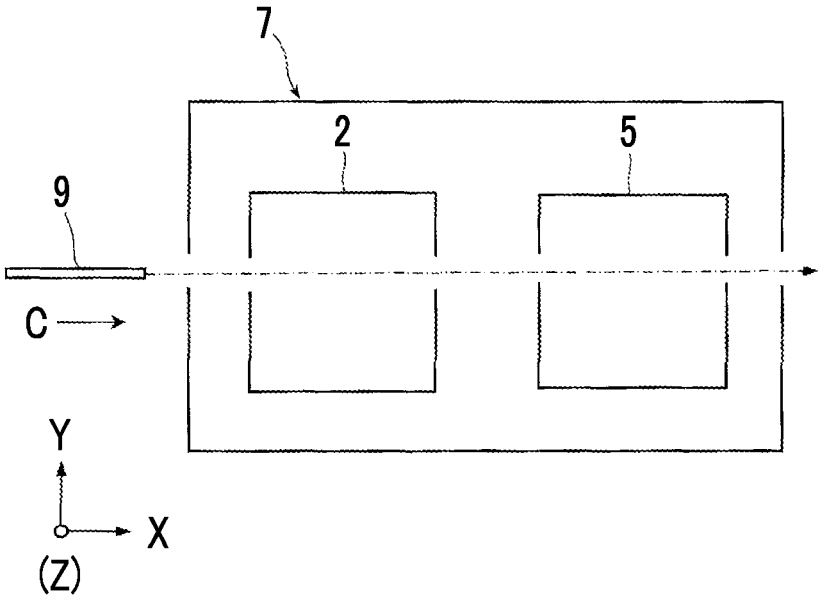
FIG. 13A is a conceptual view of a treatment system according to the modification example of the second exemplary embodiment.

For example, as shown in FIG. 13A, a treatment system that is formed by a powder coating device, a printing device, and other image forming devices, and adopts the treatment device 2 performing other treatment, such as powder coating, printing, and image forming under other image forming methods, on the object to be treated 9 as another treatment device 2 that performs other treatment other than heat treatment may be adopted as another example of the treatment system 7. In this case, an appropriate device such as the heating device 5A, the cooling device 5B, and the drying device, which are described above, is used as the heat treatment device 5.

Figure 13B:
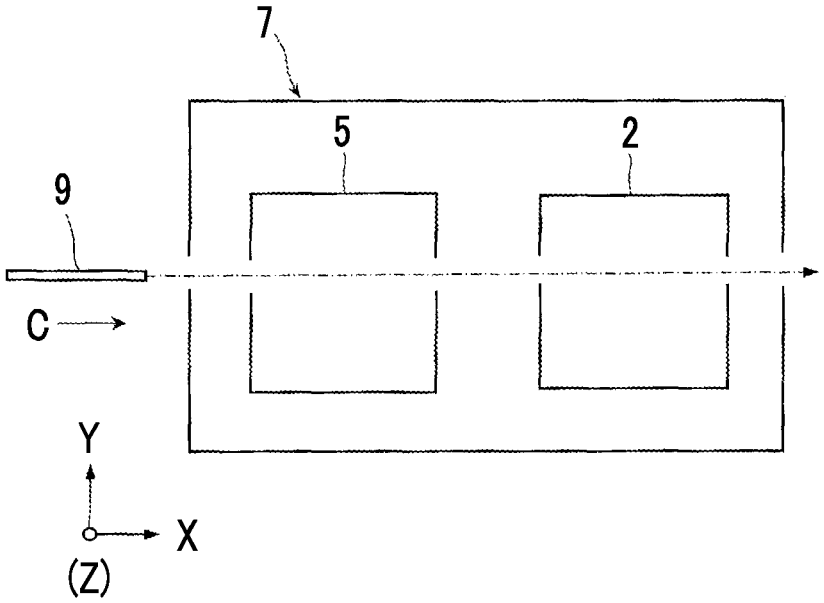
FIG. 13B is a conceptual view showing another configuration example of the treatment system according to the modification example of the second exemplary embodiment.

In addition, as shown in FIG. 13B, the treatment system 7 is applicable even in a case where the treatment device 2 is a device that performs other treatment, other than heat exchange by the heat treatment device 5, on the object to be treated 9 after passing through the heat treatment device 5.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A thermally conductive pipe comprising:

a pipe of which both end portions are closed;

a working liquid that is sealed inside the pipe and vaporizes and liquefies; and a liquid transfer unit that exists along a longitudinal direction inside the pipe and transfers the liquefied working liquid at least in the longitudinal direction, wherein the liquid transfer unit has, in a case of being viewed in a cross section of the pipe, which is orthogonal to the longitudinal direction, a first liquid transfer unit that is formed of a net-shaped material made of a metal wire and is in contact with at least a partial range of an inner wall surface of the pipe and a second liquid transfer unit that comprises a metal rod and is not in contact with the inner wall surface of the pipe and the first liquid transfer unit and is physically connected to both ends of the end portions.

2. The thermally conductive pipe according to claim 1, wherein the pipe is a pipe that has a circular cross section having an outer diameter of 3 mm or less.

3. A heat treatment device comprising:

a heat treatment unit that comprises a roller and exchanges heat with an object to be treated passing through the heat treatment unit while being in contact therewith; and a thermally conductive pipe that is provided over a portion of the heat treatment unit, which corresponds to a passing region through which the object to be treated passes, and a portion of the heat treatment unit, which corresponds to a non-passing region through which the object to be treated does not pass, wherein the thermally conductive pipe according to claim 1 is used as the thermally conductive pipe.

4. The heat treatment device according to claim 3, wherein the first liquid transfer unit of the thermally conductive pipe is in contact with a range including a portion of an inner wall surface of the pipe, which is in contact with a high temperature portion of the heat treatment unit of which heat is to be absorbed at a time of heat exchange.

5. A treatment system comprising:

a heat treatment device that has a heat treatment unit, which exchanges heat with an object to be treated passing through the heat treatment unit while being in contact therewith, wherein the heat treatment device is configured to include the heat treatment device according to claim 3.

* * * * *